US009082257B2

(12) United States Patent
Caputo et al.

(10) Patent No.: US 9,082,257 B2
(45) Date of Patent: Jul. 14, 2015

(54) GAMING SYSTEM AND METHOD PROVIDING A COMMUNITY SELECTION GAME PROVIDING BONUS GAME SELECTION

(75) Inventors: Scott A. Caputo, Santa Clara, CA (US); Mark C. Nicely, Daly City, CA (US); Bryan D. Wolf, Reno, NV (US); Kelsy J. Grace, Reno, NV (US); Anthony J. Baerlocher, Reno, NV (US)

(73) Assignee: IGT, Las Vegas, NV (US)

( * ) Notice: Subject to any disclaimer, the term of this patent is extended or adjusted under 35 U.S.C. 154(b) by 338 days.

(21) Appl. No.: 13/584,490

(22) Filed: Aug. 13, 2012

(65) Prior Publication Data

US 2013/0084941 A1 Apr. 4, 2013

Related U.S. Application Data

(60) Provisional application No. 61/541,254, filed on Sep. 30, 2011.

(51) Int. Cl.
*G07F 17/32* (2006.01)
*G07F 17/34* (2006.01)

(52) U.S. Cl.
CPC ..... *G07F 17/3223* (2013.01); *G07F 17/3244* (2013.01); *G07F 17/34* (2013.01)

(58) Field of Classification Search
CPC ..... G07F 17/3223
See application file for complete search history.

(56) References Cited

U.S. PATENT DOCUMENTS

| | | | |
|---|---|---|---|
| 3,167,313 | A | 1/1965 | Davenport et al. |
| 3,618,952 | A | 11/1971 | Tallarida |
| 4,003,578 | A | 1/1977 | Jones |
| 4,277,067 | A | 7/1981 | Gettleman |

(Continued)

FOREIGN PATENT DOCUMENTS

| | | |
|---|---|---|
| EP | 0 874 337 A1 | 10/1998 |
| EP | 0 945 837 | 9/1999 |

(Continued)

OTHER PUBLICATIONS

International Search Report and Written Opinion of the International Searching Authority for corresponding PCT Application No. PCT/US2012/052808, dated Jan. 22, 2013 (11 pages).

*Primary Examiner* — Seng H Lim
(74) *Attorney, Agent, or Firm* — Neal, Gerber & Eisenberg LLP

(57) ABSTRACT

Gaming systems and methods providing a community selection game providing bonus game selection. In one embodiment, for each gaming device in the gaming system, when a triggering event occurs, the gaming system provides a player of that gaming device with a player identifier that uniquely identifies that player. The community selection game includes a plurality of bonus game identifiers each identifying a bonus game. The bonus game identifiers each include a limited quantity of bonus game player identifier display areas. The gaming system enables the players to place earned or received player identifiers at the bonus game player identifier display areas. When each bonus game player identifier display area of one of the displayed bonus game identifiers displays a player identifier, the players associated with those player identifiers are provided with one or more plays of the bonus game identified by that bonus game identifier.

35 Claims, 15 Drawing Sheets

(56) References Cited

U.S. PATENT DOCUMENTS

| | | | |
|---|---|---|---|
| 4,323,242 | A | 4/1982 | Rosenfeld |
| 4,511,143 | A | 4/1985 | Sankrithi |
| 4,582,324 | A | 4/1986 | Koza et al. |
| 4,618,150 | A | 10/1986 | Kimura |
| 4,624,459 | A | 11/1986 | Kaufman |
| 4,695,053 | A | 9/1987 | Vazquez, Jr. et al. |
| 4,760,527 | A | 7/1988 | Sidley |
| 4,850,592 | A | 7/1989 | Winter |
| 4,856,787 | A | 8/1989 | Itkis |
| 4,926,327 | A | 5/1990 | Sidley |
| 5,046,737 | A | 9/1991 | Fienberg |
| 5,083,800 | A | 1/1992 | Lockton |
| 5,178,395 | A | 1/1993 | Lovell |
| 5,205,555 | A | 4/1993 | Hamano |
| 5,294,120 | A | 3/1994 | Schultz |
| 5,333,868 | A | 8/1994 | Goldfarb |
| 5,342,047 | A | 8/1994 | Heidel et al. |
| 5,393,057 | A | 2/1995 | Marnell, II |
| 5,449,173 | A | 9/1995 | Thomas et al. |
| 5,511,781 | A | 4/1996 | Wood et al. |
| 5,536,016 | A | 7/1996 | Thompson |
| 5,564,700 | A | 10/1996 | Celona |
| 5,566,942 | A | 10/1996 | Elum |
| 5,611,730 | A | 3/1997 | Weiss |
| 5,655,961 | A | 8/1997 | Acres et al. |
| 5,664,998 | A | 9/1997 | Seelig et al. |
| 5,741,183 | A | 4/1998 | Acres et al. |
| 5,752,882 | A | 5/1998 | Acres et al. |
| 5,762,552 | A | 6/1998 | Vuong et al. |
| 5,769,716 | A | 6/1998 | Saffari et al. |
| 5,772,509 | A | 6/1998 | Weiss |
| 5,813,672 | A | 9/1998 | Loud, Jr. |
| 5,820,459 | A | 10/1998 | Acres et al. |
| 5,823,873 | A | 10/1998 | Moody |
| 5,823,874 | A | 10/1998 | Adams |
| 5,833,537 | A | 11/1998 | Barrie |
| 5,833,538 | A | 11/1998 | Weiss |
| 5,836,817 | A | 11/1998 | Acres et al. |
| 5,848,932 | A | 12/1998 | Adams |
| 5,851,148 | A | 12/1998 | Brune et al. |
| 5,873,781 | A | 2/1999 | Keane |
| 5,876,284 | A | 3/1999 | Acres et al. |
| 5,882,261 | A | 3/1999 | Adams |
| 5,911,418 | A | 6/1999 | Adams |
| 5,927,714 | A | 7/1999 | Kaplan |
| 5,938,200 | A | 8/1999 | Markowicz et al. |
| 5,947,820 | A | 9/1999 | Morro et al. |
| 5,951,397 | A | 9/1999 | Dickinson |
| 5,961,384 | A | 10/1999 | Robinson |
| 5,967,894 | A | 10/1999 | Kinoshita et al. |
| 5,976,016 | A | 11/1999 | Moody et al. |
| 5,980,384 | A | 11/1999 | Barrie |
| 5,984,781 | A | 11/1999 | Sunaga |
| 6,004,207 | A | 12/1999 | Wilson, Jr. et al. |
| 6,012,982 | A | 1/2000 | Piechowiak et al. |
| 6,015,346 | A | 1/2000 | Bennett |
| 6,033,307 | A | 3/2000 | Vancura |
| 6,056,642 | A | 5/2000 | Bennett |
| 6,059,289 | A | 5/2000 | Vancura |
| 6,059,658 | A | 5/2000 | Mangano et al. |
| 6,062,980 | A | 5/2000 | Luciano |
| 6,089,976 | A | 7/2000 | Schneider et al. |
| 6,089,977 | A | 7/2000 | Bennett |
| 6,089,978 | A | 7/2000 | Adams |
| 6,089,980 | A | 7/2000 | Gauselmann |
| 6,102,798 | A | 8/2000 | Bennett |
| 6,120,031 | A | 9/2000 | Adams |
| 6,120,377 | A | 9/2000 | McGinnis, Sr. et al. |
| 6,120,378 | A | 9/2000 | Moody et al. |
| 6,126,542 | A | 10/2000 | Fier |
| 6,134,556 | A | 10/2000 | Shin |
| 6,135,884 | A | 10/2000 | Hedrick et al. |
| 6,142,872 | A | 11/2000 | Walker et al. |
| 6,142,874 | A | 11/2000 | Kodachi et al. |
| 6,155,925 | A | 12/2000 | Giobbi et al. |
| 6,159,095 | A | 12/2000 | Frohm et al. |
| 6,159,097 | A | 12/2000 | Gura |
| 6,159,098 | A | 12/2000 | Slomiany et al. |
| 6,162,122 | A | 12/2000 | Acres et al. |
| 6,164,652 | A | 12/2000 | Lauretta et al. |
| 6,168,523 | B1 | 1/2001 | Piechowiak et al. |
| 6,174,235 | B1 | 1/2001 | Walker et al. |
| 6,186,894 | B1 | 2/2001 | Mayeroff |
| 6,190,254 | B1 | 2/2001 | Bennett |
| 6,190,255 | B1 | 2/2001 | Thomas et al. |
| 6,203,430 | B1 | 3/2001 | Walker et al. |
| 6,206,782 | B1 | 3/2001 | Walker et al. |
| 6,210,275 | B1 | 4/2001 | Olsen |
| 6,231,442 | B1 | 5/2001 | Mayeroff |
| 6,231,445 | B1 | 5/2001 | Acres |
| 6,234,897 | B1 | 5/2001 | Frohm et al. |
| 6,244,958 | B1 | 6/2001 | Acres |
| 6,254,483 | B1 | 7/2001 | Acres |
| 6,257,981 | B1 | 7/2001 | Acres et al. |
| 6,261,177 | B1 | 7/2001 | Bennett |
| 6,270,411 | B1 | 8/2001 | Gura et al. |
| 6,273,420 | B1 | 8/2001 | Brooks |
| 6,299,165 | B1 | 10/2001 | Nagano |
| 6,302,790 | B1 | 10/2001 | Brossard |
| 6,309,299 | B1 | 10/2001 | Weiss |
| 6,309,300 | B1 | 10/2001 | Glavich |
| 6,311,976 | B1 | 11/2001 | Yoseloff et al. |
| 6,312,332 | B1 | 11/2001 | Walker et al. |
| 6,312,333 | B1 | 11/2001 | Acres |
| 6,312,334 | B1 | 11/2001 | Yoseloff |
| 6,315,660 | B1 | 11/2001 | DeMar et al. |
| 6,315,664 | B1 | 11/2001 | Baerlocher et al. |
| 6,319,124 | B1 | 11/2001 | Baerlocher et al. |
| 6,319,125 | B1 | 11/2001 | Acres |
| 6,328,649 | B1 | 12/2001 | Randall et al. |
| 6,336,860 | B1 | 1/2002 | Webb |
| 6,346,043 | B1 | 2/2002 | Colin et al. |
| 6,361,441 | B1 | 3/2002 | Walker et al. |
| 6,364,314 | B1 | 4/2002 | Canterbury |
| 6,364,765 | B1 | 4/2002 | Walker et al. |
| 6,364,767 | B1 | 4/2002 | Brossard et al. |
| 6,364,768 | B1 | 4/2002 | Acres et al. |
| 6,371,852 | B1 | 4/2002 | Acres |
| 6,375,567 | B1 | 4/2002 | Acres |
| 6,375,569 | B1 | 4/2002 | Acres |
| 6,386,975 | B1 | 5/2002 | Peterson |
| 6,394,902 | B1 | 5/2002 | Glavich et al. |
| 6,398,218 | B1 | 6/2002 | Vancura |
| 6,398,643 | B1 | 6/2002 | Knowles et al. |
| 6,398,645 | B1 | 6/2002 | Yoseloff |
| 6,406,369 | B1 | 6/2002 | Baerlocher et al. |
| 6,413,161 | B1 | 7/2002 | Baerlocher et al. |
| 6,416,408 | B2 | 7/2002 | Tracy et al. |
| 6,425,824 | B1 | 7/2002 | Baerlocher et al. |
| 6,431,983 | B2 | 8/2002 | Acres |
| 6,439,995 | B1 | 8/2002 | Hughs-Baird et al. |
| 6,443,452 | B1 | 9/2002 | Brune |
| 6,450,883 | B1 | 9/2002 | O'Halloran |
| RE37,885 | E | 10/2002 | Acres et al. |
| 6,461,241 | B1 | 10/2002 | Webb et al. |
| 6,471,210 | B1 | 10/2002 | Goldman et al. |
| 6,482,089 | B2 | 11/2002 | DeMar et al. |
| 6,494,785 | B1 | 12/2002 | Gerrard et al. |
| 6,503,146 | B2 | 1/2003 | Walker et al. |
| 6,506,117 | B2 | 1/2003 | DeMar et al. |
| 6,508,707 | B2 | 1/2003 | DeMar et al. |
| 6,511,375 | B1 | 1/2003 | Kaminkow |
| 6,514,141 | B1 | 2/2003 | Kaminkow et al. |
| 6,517,073 | B1 | 2/2003 | Vancura |
| 6,520,855 | B2 | 2/2003 | DeMar et al. |
| 6,554,703 | B1 | 4/2003 | Bussick et al. |
| 6,558,254 | B2 | 5/2003 | Baelocher et al. |
| 6,561,904 | B2 | 5/2003 | Locke et al. |
| 6,565,434 | B1 | 5/2003 | Acres |
| 6,565,436 | B1 | 5/2003 | Baerlocher |
| 6,569,015 | B1 | 5/2003 | Baerlocher et al. |
| 6,569,016 | B1 | 5/2003 | Baerlocher |
| 6,572,469 | B2 | 6/2003 | Klitsner et al. |
| 6,572,473 | B1 | 6/2003 | Baerlocher |

(56) References Cited

U.S. PATENT DOCUMENTS 6,575,830 B2 6/2003 Baerlocher et al.
6,582,307 B2 6/2003 Webb
6,585,591 B1 7/2003 Baerlocher et al.
6,589,117 B1 7/2003 Moritome et al.
6,595,854 B2 7/2003 Hughs-Baird et al.
6,599,185 B1 7/2003 Kaminkow et al.
6,599,193 B2 7/2003 Baerlocher et al.
6,602,135 B1 8/2003 Gerrard
6,602,136 B1 8/2003 Baerlocher et al.
6,602,137 B2 8/2003 Kaminkow et al.
6,607,438 B2 8/2003 Baerlocher et al.
6,607,441 B1 8/2003 Acres
6,609,974 B2 8/2003 Mead et al.
6,638,164 B2 10/2003 Randall et al.
6,641,477 B1 11/2003 Dietz, II
6,645,073 B2 11/2003 Lemay et al.
6,645,074 B2 11/2003 Thomas et al.
6,648,754 B2 11/2003 Baerlocher et al.
6,659,461 B2 12/2003 Yoseloff et al.
6,668,975 B2 12/2003 Skipper
6,676,516 B2 1/2004 Baerlocher et al.
6,682,419 B2 1/2004 Webb et al.
6,682,420 B2 1/2004 Webb et al.
6,685,560 B1 2/2004 Hughes
6,688,975 B2 2/2004 Baerlocher et al.
6,692,353 B2 2/2004 Walker et al.
6,692,355 B2 2/2004 Baerlocher et al.
6,692,356 B2 2/2004 Baerlocher et al.
6,712,697 B2 3/2004 Acres
6,712,699 B2 3/2004 Walker et al.
6,722,981 B2 4/2004 Kaminkow et al.
6,722,982 B2 4/2004 Kaminkow et al.
6,722,983 B2 4/2004 Kaminkow et al.
6,726,525 B1 4/2004 Kato et al.
6,726,563 B1 4/2004 Baerlocher et al.
6,726,565 B2 4/2004 Hughs-Baird
6,733,386 B2 5/2004 Cuddy et al.
6,733,389 B2 5/2004 Webb et al.
6,733,390 B2 5/2004 Walker et al.
6,743,096 B2 6/2004 Allendorf et al.
6,749,502 B2 6/2004 Baerlocher
6,749,504 B2 6/2004 Hughs-Baird
6,758,747 B2 7/2004 Baerlocher
6,761,632 B2 7/2004 Bansemer et al.
6,769,983 B2 8/2004 Slomiany
6,776,711 B1 8/2004 Baerlocher
6,780,103 B2 8/2004 Bansemer et al.
6,780,107 B2 8/2004 Baerlocher et al.
6,780,110 B2 8/2004 Baerlocher et al.
6,780,111 B2 8/2004 Cannon et al.
6,783,457 B2 8/2004 Hughs-Baird et al.
6,783,458 B2 8/2004 Mead et al.
6,796,899 B2 9/2004 Baerlocher
6,796,901 B2 9/2004 Baerlocher
6,800,030 B2 10/2004 Acres
6,808,452 B2 10/2004 Baerlocher et al.
6,811,482 B2 11/2004 Letovsky
6,814,664 B2 11/2004 Baerlocher et al.
6,817,943 B2 11/2004 Gerrard
6,817,944 B2 11/2004 Kaminkow et al.
6,832,958 B2 12/2004 Acres et al.
6,837,793 B2 1/2005 McClintic
6,843,721 B2 1/2005 Vancura
6,843,722 B2 1/2005 Webb
6,857,958 B2 2/2005 Osawa
6,860,810 B2 3/2005 Cannon et al.
6,863,606 B1 3/2005 Berg et al.
6,863,607 B2 3/2005 Gerrard
6,866,583 B2 3/2005 Glavich et al.
6,875,108 B1 4/2005 Hughs-Baird
6,890,257 B2 5/2005 Baerlocher
6,899,620 B2 5/2005 Kaminkow et al.
6,902,478 B2 6/2005 McClintic
6,910,964 B2 6/2005 Acres
6,910,965 B2 6/2005 Downes
6,913,532 B2 7/2005 Baerlocher et al.
6,913,533 B2 7/2005 Cuddy et al.
6,913,535 B2 7/2005 Kaminkow et al.
6,918,830 B2 7/2005 Baerlocher
6,932,701 B2 8/2005 Glavich et al.
6,935,955 B1 8/2005 Kaminkow et al.
6,939,224 B2 9/2005 Palmer et al.
RE38,812 E 10/2005 Acres et al.
6,955,600 B2 10/2005 Glavich et al.
6,958,013 B2 10/2005 Miereau et al.
6,960,132 B2 11/2005 Baerlocher et al.
6,964,608 B1 11/2005 Koza
6,966,833 B2 11/2005 Kaminkow et al.
6,971,954 B2 12/2005 Randall et al.
6,971,955 B2 12/2005 Baerlocher et al.
6,979,263 B2 12/2005 Baerlocher et al.
6,981,917 B2 1/2006 Webb et al.
6,988,947 B2 1/2006 Baerlocher et al.
6,995,751 B2 2/2006 Falvo
6,996,833 B1 2/2006 Olson et al.
7,029,395 B1 4/2006 Baerlocher
7,037,191 B2 5/2006 Rodgers et al.
7,037,192 B2 5/2006 Baerlocher et al.
7,040,983 B2 5/2006 Dolloff et al.
7,040,984 B2 5/2006 Mead
7,052,392 B2 5/2006 Tessmer et al.
7,056,210 B2 6/2006 Bansemer et al.
7,056,214 B2 6/2006 Miereau et al.
7,059,965 B2 6/2006 Jackson
7,066,466 B1 6/2006 Stavinsky et al.
7,066,814 B2 6/2006 Glavich et al.
7,077,744 B2 7/2006 Cannon
7,094,148 B2 8/2006 Baerlocher et al.
7,104,888 B2 9/2006 Miereau et al.
7,112,137 B2 9/2006 Baerlocher et al.
7,121,942 B2 10/2006 Baerlocher
7,128,646 B2 10/2006 Baerlocher et al.
7,128,647 B2 10/2006 Muir
7,131,908 B2 11/2006 Baerlocher
7,137,884 B2 11/2006 Gilmore
7,137,886 B2 11/2006 Locke et al.
7,160,186 B2 1/2007 Cuddy et al.
7,160,188 B2 1/2007 Kaminkow et al.
7,169,041 B2 1/2007 Tessmer et al.
7,169,042 B2 1/2007 Muir et al.
7,169,046 B2 1/2007 Webb et al.
7,169,047 B2 1/2007 Benbrahim
7,172,506 B2 2/2007 Baerlocher et al.
7,175,523 B2 2/2007 Gilmore et al.
7,175,524 B2 2/2007 Bansemer et al.
7,182,689 B2 2/2007 Hughs-Baird et al.
7,192,344 B2 3/2007 Baerlocher
7,192,347 B1 3/2007 Marks et al.
7,192,350 B2 3/2007 Nguyen
7,192,352 B2 3/2007 Walker et al.
7,195,560 B2 3/2007 DeMar et al.
7,198,570 B2 4/2007 Rodgers et al.
7,201,657 B2 4/2007 Baerlocher et al.
7,204,259 B2 4/2007 Crisp, III
7,220,180 B2 5/2007 Kaminkow et al.
7,223,172 B2 5/2007 Baerlochet et al.
7,235,009 B2 6/2007 Baerlocher
7,235,011 B2 6/2007 Randall et al.
7,238,110 B2 7/2007 Glavich et al.
7,247,092 B2 7/2007 Jarvis et al.
7,250,001 B2 7/2007 Baerlocher et al.
7,258,611 B2 8/2007 Bigelow, Jr. et al.
7,264,545 B2 9/2007 Maya et al.
7,273,415 B2 9/2007 Cregan et al.
7,297,058 B2 11/2007 Gomez et al.
7,300,348 B2 11/2007 Kaminkow et al.
7,302,650 B1 11/2007 Allyn et al.
7,303,469 B2 12/2007 Kaminkow et al.
7,306,518 B2 12/2007 Hughs-Baird et al.
7,311,598 B2 12/2007 Kaminkow et al.
7,311,604 B2 12/2007 Kaminkow et al.
7,314,408 B2 1/2008 Cannon
7,314,409 B2 1/2008 Maya et al.
7,314,410 B2 1/2008 Baerlocher et al.

(56) References Cited

U.S. PATENT DOCUMENTS 7,316,609 B2 1/2008 Dunn et al.
7,318,773 B2 1/2008 Baerlocher
7,322,887 B2 1/2008 Belger et al.
7,326,115 B2 2/2008 Baerlocher
7,329,179 B2 2/2008 Baerlocher
7,331,863 B2 2/2008 Baerlocher
7,337,864 B2 3/2008 Ruck
7,338,364 B2 3/2008 Baerlocher et al.
7,338,367 B2 3/2008 Kaminkow et al.
7,338,369 B2 3/2008 Mierau et al.
7,338,370 B2 3/2008 Oles et al.
7,338,371 B2 3/2008 Cheng et al.
7,351,140 B2 4/2008 Wolf et al.
7,351,141 B2 4/2008 Rodgers et al.
7,354,344 B2 4/2008 Paulsen et al.
7,357,712 B2 4/2008 Mead et al.
7,361,086 B2 4/2008 Gazdic et al.
7,361,087 B2 4/2008 Baerlocher et al.
7,364,510 B2 4/2008 Walker et al.
7,367,883 B2 5/2008 Gagnon
7,371,166 B1 5/2008 Webb et al.
7,371,171 B1 5/2008 Englman et al.
7,371,174 B2 5/2008 Baerlocher
7,377,849 B2 5/2008 Baerlocher et al.
7,381,134 B2 6/2008 Cuddy et al.
7,393,280 B2 7/2008 Cannon
7,402,103 B2 7/2008 Baerlocher
7,413,510 B2 8/2008 Schlegel et al.
7,419,162 B2 9/2008 Lancaster et al.
7,427,236 B2 9/2008 Kaminkow et al.
7,435,174 B2 10/2008 Baerlocher et al.
7,448,949 B2 11/2008 Kaminkow et al.
7,455,588 B2 11/2008 Webb et al.
7,470,184 B2 12/2008 Baerlocher et al.
7,470,187 B2 12/2008 Baerlocher et al.
7,470,188 B2 12/2008 Baerlocher et al.
7,470,189 B2 12/2008 Baerlocher et al.
7,470,190 B2 12/2008 Baerlocher et al.
7,500,915 B2 3/2009 Wolf et al.
7,513,827 B2 4/2009 Baerlocher
7,588,496 B2 9/2009 Van Asdale
7,591,724 B2 9/2009 Baerlocher
7,618,316 B2 11/2009 Cole et al.
2001/0055990 A1 12/2001 Acres
2002/0052232 A1 5/2002 Kaminkow
2003/0013514 A1 1/2003 Cregan et al.
2003/0036422 A1 2/2003 Baerlocher et al.
2003/0036424 A1 2/2003 Baerlocher
2003/0036430 A1 2/2003 Cannon
2003/0040358 A1 2/2003 Rothkranz et al.
2003/0060266 A1 3/2003 Baerlocher
2003/0064773 A1 4/2003 Baerlocher et al.
2003/0125107 A1 7/2003 Cannon
2003/0153378 A1 8/2003 Schlegel et al.
2003/0162584 A1 8/2003 Hughs-Baird et al.
2003/0181233 A1 9/2003 Baerlocher et al.
2003/0190945 A1 10/2003 Bussick et al.
2003/0228904 A1 12/2003 Acres et al.
2003/0236115 A1 12/2003 Chamberlain
2004/0038724 A1 2/2004 Asdale
2004/0048644 A1 3/2004 Gerrard et al.
2004/0048649 A1 3/2004 Peterson et al.
2004/0048673 A1 3/2004 Kaminkow
2004/0053665 A1 3/2004 Baerlocher
2004/0082378 A1 4/2004 Peterson et al.
2004/0171416 A1 9/2004 Baerlocher et al.
2004/0195773 A1 10/2004 Masci et al.
2004/0242315 A1 12/2004 Paulsen et al.
2004/0242316 A1 12/2004 Oles et al.
2004/0248639 A1 12/2004 Slomiany
2005/0020351 A1 1/2005 Baerlocher et al.
2005/0032573 A1 2/2005 Acres et al.
2005/0033461 A1 2/2005 Gerrard et al.
2005/0037840 A1 2/2005 Baerlocher
2005/0054404 A1 3/2005 Baerlocher
2005/0054405 A1 3/2005 Baerlocher et al.
2005/0054411 A1 3/2005 Hughs-Baird et al.
2005/0054415 A1 3/2005 Kaminkow et al.
2005/0054416 A1 3/2005 Hostetler et al.
2005/0054430 A1 3/2005 Pitman et al.
2005/0054435 A1 3/2005 Rodgers et al.
2005/0054436 A1 3/2005 Frizzell et al.
2005/0059446 A1 3/2005 Kaminkow
2005/0059455 A1 3/2005 Gerrard et al.
2005/0059456 A1 3/2005 Mead et al.
2005/0059461 A1 3/2005 Ching et al.
2005/0064924 A1 3/2005 Glavich et al.
2005/0064928 A1 3/2005 Baerlocher et al.
2005/0070353 A1 3/2005 Webb et al.
2005/0075163 A1 4/2005 Cuddy et al.
2005/0096123 A1 5/2005 Cregan et al.
2005/0101372 A1 5/2005 Mierau et al.
2005/0101374 A1 5/2005 Acres
2005/0170876 A1 8/2005 Masci et al.
2005/0181860 A1 8/2005 Nguyen et al.
2005/0192081 A1 9/2005 Marks et al.
2005/0197180 A1 9/2005 Kaminkow et al.
2005/0218591 A1 10/2005 Torigian et al.
2006/0025195 A1 2/2006 Pennington et al.
2006/0025196 A1 2/2006 Webb et al.
2006/0030387 A1 2/2006 Jackson
2006/0030401 A1 2/2006 Mead et al.
2006/0040723 A1 2/2006 Baerlocher et al.
2006/0040732 A1 2/2006 Baerlocher et al.
2006/0040733 A1 2/2006 Baerlocher et al.
2006/0040734 A1 2/2006 Baerlocher et al.
2006/0040736 A1 2/2006 Baerlocher et al.
2006/0063582 A1 3/2006 Baerlocher et al.
2006/0063585 A1 3/2006 Cuddy
2006/0068882 A1 3/2006 Baerlocher et al.
2006/0068884 A1 3/2006 Baerlocher et al.
2006/0068885 A1 3/2006 Cregan et al.
2006/0073874 A1 4/2006 Cregan et al.
2006/0073876 A1 4/2006 Cuddy
2006/0073877 A1 4/2006 Rodgers et al.
2006/0084486 A1 4/2006 Belger et al.
2006/0084494 A1 4/2006 Belger et al.
2006/0084500 A1 4/2006 Baerlocher et al.
2006/0111164 A1 5/2006 Hornik et al.
2006/0135238 A1 6/2006 Lancaster et al.
2006/0183528 A1 8/2006 Rodgers et al.
2006/0199628 A1 9/2006 Rodgers et al.
2006/0205474 A1 9/2006 Bansemer et al.
2006/0217189 A1 9/2006 Walker et al.
2006/0246977 A1 11/2006 Cannon
2007/0015566 A1 1/2007 Baerlocher et al.
2007/0032285 A1 2/2007 Wolf
2007/0049372 A1 3/2007 Olivas et al.
2007/0054732 A1 3/2007 Baerlocher
2007/0054733 A1 3/2007 Baerlocher
2007/0060271 A1 3/2007 Cregan et al.
2007/0060292 A1 3/2007 Peterson
2007/0060300 A1 3/2007 Baerlocher
2007/0060321 A1 3/2007 Vasquez et al.
2007/0077990 A1 4/2007 Cuddy et al.
2007/0082725 A1 4/2007 Low et al.
2007/0087809 A1 4/2007 Baerlocher
2007/0105619 A1 5/2007 Kniesteadt et al.
2007/0105620 A1 5/2007 Cuddy et al.
2007/0111783 A1 5/2007 Cuddy et al.
2007/0117606 A1 5/2007 Baerlocher et al.
2007/0117610 A1 5/2007 Webb et al.
2007/0129131 A1 6/2007 Kaminkow et al.
2007/0129133 A1 6/2007 Bansemer et al.
2007/0135193 A1 6/2007 Nicely
2007/0149269 A1 6/2007 Benbrahim
2007/0149270 A1 6/2007 Baerlocher et al.
2007/0149292 A1 6/2007 Kaminkow et al.
2007/0155485 A1 7/2007 Cuddy et al.
2007/0167208 A1 7/2007 Acres
2007/0167217 A1 7/2007 Kaminkow et al.
2007/0178963 A1 8/2007 Sato
2007/0184891 A1 8/2007 Thomas
2007/0184894 A1 8/2007 Baerlocher

(56) References Cited

U.S. PATENT DOCUMENTS

| | | | |
|---|---|---|---|
| 2007/0197276 | A1 | 8/2007 | Sato |
| 2007/0213119 | A1 | 9/2007 | Baerlocher et al. |
| 2007/0259706 | A1 | 11/2007 | Anderson et al. |
| 2007/0293293 | A1 | 12/2007 | Baerlocher et al. |
| 2007/0298874 | A1 | 12/2007 | Baerlocher et al. |
| 2007/0298875 | A1 | 12/2007 | Baerlocher et al. |
| 2008/0004105 | A1 | 1/2008 | Cregan et al. |
| 2008/0009334 | A1 | 1/2008 | Walker et al. |
| 2008/0020815 | A1 | 1/2008 | Lancaster et al. |
| 2008/0020817 | A1 | 1/2008 | Kaminkow et al. |
| 2008/0020822 | A1 | 1/2008 | Cuddy et al. |
| 2008/0020823 | A1 | 1/2008 | Cuddy et al. |
| 2008/0020824 | A1 | 1/2008 | Cuddy et al. |
| 2008/0020825 | A1 | 1/2008 | Cuddy et al. |
| 2008/0020829 | A1 | 1/2008 | Baerlocher |
| 2008/0020847 | A1 | 1/2008 | Kniesteadt et al. |
| 2008/0026813 | A1 | 1/2008 | Cannon |
| 2008/0032764 | A1 | 2/2008 | Cannon |
| 2008/0051168 | A1 | 2/2008 | Kaminkow et al. |
| 2008/0070674 | A1 | 3/2008 | Lancaster et al. |
| 2008/0070676 | A1 | 3/2008 | Baerlocher et al. |
| 2008/0070677 | A1 | 3/2008 | Baerlocher et al. |
| 2008/0070678 | A1 | 3/2008 | Baerlocher et al. |
| 2008/0070702 | A1 | 3/2008 | Kaminkow et al. |
| 2008/0076500 | A1 | 3/2008 | Lancaster et al. |
| 2008/0076514 | A1 | 3/2008 | Baerlocher et al. |
| 2008/0076515 | A1 | 3/2008 | Baerlocher et al. |
| 2008/0076517 | A1 | 3/2008 | Baerlocher et al. |
| 2008/0076531 | A1 | 3/2008 | Baerlocher et al. |
| 2008/0076532 | A1 | 3/2008 | Graham et al. |
| 2008/0076542 | A1 | 3/2008 | Iddings et al. |
| 2008/0081690 | A1 | 4/2008 | Baerlocher et al. |
| 2008/0081691 | A1 | 4/2008 | Baerlocher et al. |
| 2008/0102916 | A1 | 5/2008 | Kovacs et al. |
| 2008/0102920 | A1 | 5/2008 | Baerlocher |
| 2008/0108401 | A1 | 5/2008 | Baerlocher et al. |
| 2008/0108406 | A1 | 5/2008 | Oberberger |
| 2008/0108425 | A1 | 5/2008 | Oberberger |
| 2008/0108429 | A1 | 5/2008 | Davis et al. |
| 2008/0108436 | A1 | 5/2008 | Oberberger |
| 2008/0113735 | A1 | 5/2008 | Maya |
| 2008/0113765 | A1 | 5/2008 | DeWaal |
| 2008/0113768 | A1 | 5/2008 | Baerlocher |
| 2008/0113771 | A1 | 5/2008 | Baerlocher et al. |
| 2008/0113779 | A1 | 5/2008 | Cregan |
| 2008/0139274 | A1 | 6/2008 | Baerlocher |
| 2008/0139285 | A1 | 6/2008 | Zimmermann |
| 2008/0139290 | A1 | 6/2008 | Kniesteadt et al. |
| 2008/0153564 | A1 | 6/2008 | Baerlocher et al. |
| 2008/0167108 | A1 | 7/2008 | Baerlocher et al. |
| 2008/0176650 | A1 | 7/2008 | Wolf et al. |
| 2008/0182638 | A1 | 7/2008 | Paulsen et al. |
| 2008/0188278 | A1 | 8/2008 | Paulsen et al. |
| 2008/0188287 | A1 | 8/2008 | Schlegel et al. |
| 2008/0200244 | A1 | 8/2008 | Rowe et al. |
| 2008/0214272 | A1 | 9/2008 | Baerlocher et al. |
| 2008/0234034 | A1 | 9/2008 | Tessmer et al. |
| 2008/0274790 | A1 | 11/2008 | Cannon |
| 2008/0311980 | A1 | 12/2008 | Cannon |
| 2009/0036202 | A1 | 2/2009 | Baerlocher et al. |
| 2009/0104959 | A1 | 4/2009 | Caputo et al. |
| 2009/0111560 | A1 | 4/2009 | Davis et al. |
| 2009/0117974 | A1 | 5/2009 | Hornik |
| 2009/0124327 | A1 | 5/2009 | Caputo et al. |
| 2009/0124366 | A1 | 5/2009 | Aoki et al. |
| 2009/0124385 | A1 | 5/2009 | Cuddy et al. |
| 2009/0209320 | A1 | 8/2009 | Walker et al. |
| 2009/0253492 | A1 | 10/2009 | Caputo et al. |
| 2010/0016065 | A1 | 1/2010 | Nicely et al. |
| 2010/0029363 | A1 | 2/2010 | Hoffman et al. |
| 2010/0029364 | A1 | 2/2010 | Zielinski |
| 2010/0120521 | A1 | 5/2010 | Caputo et al. |
| 2011/0034240 | A1 | 2/2011 | Naicker et al. |
| 2011/0230251 | A1 | 9/2011 | Nicely et al. |

FOREIGN PATENT DOCUMENTS

| | | | |
|---|---|---|---|
| EP | 0 945 837 | A2 | 9/1999 |
| EP | 0 984 409 | A2 | 3/2000 |
| EP | 1 199 689 | | 4/2002 |
| EP | 1 298 607 | | 4/2003 |
| EP | 1 513 115 | | 3/2005 |
| EP | 1 531 434 | | 5/2005 |
| EP | 1 560 179 | | 8/2005 |
| GB | 2 086 631 | A | 5/1982 |
| GB | 2 161 008 | | 1/1986 |
| GB | 2 183 882 | A | 6/1987 |
| GB | 2 222 712 | A | 3/1990 |
| GB | 2 262 642 | | 6/1993 |
| GB | 2 356 280 | A | 5/2001 |
| GB | 2 395 439 | | 5/2004 |
| WO | WO 00/32286 | | 6/2000 |
| WO | WO 01/52956 | | 7/2001 |
| WO | WO 01/74464 | | 10/2001 |
| WO | WO 03/026759 | | 4/2003 |
| WO | WO 03/049053 | | 6/2003 |
| WO | WO 2005/002697 | | 1/2005 |
| WO | WO 2005/015826 | | 2/2005 |
| WO | WO 2006/020811 | | 2/2006 |
| WO | WO 2007/021724 | | 2/2007 |
| WO | WO 2007/087156 | | 8/2007 |

GAMING SYSTEM AND METHOD PROVIDING A COMMUNITY SELECTION GAME PROVIDING BONUS GAME SELECTION

PRIORITY CLAIM

This application is a non-provisional of, and claims priority to and the benefit of, U.S. Provisional Patent Application No. 61/541,254, filed on Sep. 30, 2011, the entire contents of which are incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines that provide players awards in primary or base games are well known. These gaming machines generally require a player to place a wager to activate a play of the primary game. In many of these gaming machines, any award provided to the player for the wagered-on play of the primary game is based on the player obtaining a winning symbol or a winning symbol combination and on the amount of the wager (e.g., the higher the wager, the higher the award). Symbols or symbol combinations that are less likely to occur usually provide higher awards.

In such known gaming machines, the amount of the wager placed on the primary game by the player may vary. For instance, the gaming machine may enable the player to wager a minimum number of credits, such as one credit (e.g., one cent, nickel, dime, quarter, or dollar) up to a maximum number of credits, such as five credits. This wager may be placed by the player a single time or multiple times in a single play of the primary game. For instance, a slot game may have one or more paylines and the slot game may enable the player to place a wager on each payline in a single play of the primary game. Thus, it is known that a gaming machine, such as a slot game, may enable players to place wagers of substantially different amounts on each play of the primary or base game ranging, for example, from one credit up to 125 credits (e.g., five credits on each of 25 separate paylines). This is also true for other wagering games, such as video draw poker, where players can place a wager of one or more credits on each hand and where multiple hands can be played simultaneously. Accordingly, it should be appreciated that different players play at substantially different wagering amounts or levels and at substantially different rates of play.

Secondary or bonus games are also known in gaming machines. The secondary or bonus games usually provide an award to a player in addition to any awards provided for any plays of one or more primary games. Secondary or bonus games usually do not require an additional wager by the player to be activated. Secondary or bonus games are generally activated or triggered upon an occurrence of a designated triggering symbol or triggering symbol combination in the primary game. For instance, a bonus symbol occurring on the payline on the third reel of a three reel slot machine may trigger the secondary or bonus game. When a secondary or bonus game is triggered, the gaming machine generally indicates this to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

In recent years, gaming has become more of a social leisure activity. Players often enjoy playing games in which the players compete against one another or work together toward a common goal. Accordingly, gaming establishments strive for ways to enable players to play games with other players either cooperatively or competitively to enhance the players' gaming experiences. Certain secondary or bonus games include a group gaming aspect wherein a plurality of players participate in a group bonus game for one or more bonus awards. Accordingly, there is a continuing need to provide new secondary or bonus games that include a group gaming aspect, wherein a plurality of players playing at linked gaming machines participate in a group bonus game for one or more bonus awards.

SUMMARY

Various embodiments of the present disclosure provide a gaming system and method providing a multi-player or community selection game providing bonus game selection. In certain embodiments, the gaming system includes a plurality of gaming devices, each of which is configured to display and operate one or more primary wagering games upon the placement of one or more wagers by a player. For each of the gaming devices, when a triggering event occurs, the player of that gaming device is provided with one or more player identifiers that uniquely identify that player. Each of the gaming devices of the gaming system is configured to operate a community selection game in which each player may use any player identifiers earned or received by that player. In other words, the players of the gaming devices are all able to participate in the same community selection game using their respective earned or received player identifiers. In general, the players compete against one another to gain entry into one or more bonus or secondary games (referred to herein as bonus games) represented by bonus game identifiers displayed in a community game selection area of the community selection game.

In some embodiments, the bonus game identifiers each include a limited quantity of bonus game player identifier display areas. The gaming system enables the players to place earned or received player identifiers at the bonus game player identifier display areas. More specifically, in these embodiments, when a player playing one of the gaming devices earns or receives a player identifier, the gaming system enables the player to select one of the bonus game player identifier display areas that does not already display a player identifier. The gaming system then displays the player's player identifier at the selected bonus game player identifier display area. Thus, when a player earns or receives a player identifier, the gaming system enables the player to "place" that player identifier in an empty one of the bonus game player identifier display areas. When each bonus game player identifier display area of one of the displayed bonus game identifiers displays a player identifier, the players associated with those player identifiers are provided with one or more plays of the bonus games identified by those bonus game identifiers.

Therefore, in these embodiments, once the gaming system receives a player identifier from a player in one of the bonus game player identifier display areas associated with one of the bonus game identifiers, it is guaranteed that the gaming system will provide that player with one or more plays of the bonus game identified by that bonus game identifier when that bonus game is triggered. In other words, it is guaranteed that the gaming system will provide that player with one or more plays of that bonus game when each of the bonus game player identifier display areas associated with that bonus game identifier displays a player identifier. These embodiments of the gaming system thus enable players to compete to place earned or received player identifiers in the limited quantity of bonus game player identifier display areas associated with the bonus game identifiers to be provided with one or more plays of the bonus game identified by that bonus game identifier.

In other embodiments, the displayed bonus game identifiers are each configured to accommodate an unlimited quantity of player identifiers rather than a limited quantity of player identifiers. Put differently, in these embodiments, the bonus game identifiers do not each include a limited quantity of bonus game player identifier display areas. Instead, for each bonus game identifier, the gaming system enables players to place an unlimited quantity of earned or received player identifiers in association with that bonus game identifier. The gaming system tracks and displays the quantity of player identifiers that each player has placed in association with each bonus game identifier.

In certain of these embodiments, each of the bonus game identifiers is associated with: (a) a predetermined time period; (b) a common outcome that, in some embodiments, one or more plays of the bonus game identified by that bonus game identifier; and (c) a premium outcome that, in some embodiments, is one or more plays of the bonus game identified by that bonus game identifier that are more advantageous to players than the common outcome. In these embodiments, for each bonus game identifier, the gaming system enables players to place earned or received player identifiers in association with that bonus game identifier during the predetermined time period associated with that bonus game identifier. Upon the expiration of that predetermined time period, the gaming system determines which player placed the highest quantity of player identifiers in association with that bonus game identifier during that predetermined time period. The gaming system provides the player who placed the highest quantity of player identifiers in association with that bonus game identifier during that predetermined time period with the premium outcome. The gaming system provides each of the other players who placed one or more player identifiers in association with that bonus game identifier during that predetermined time period with the common outcome.

It should be appreciated that, in these embodiments, once a player places a player identifier in association with one of the bonus game identifiers, it is guaranteed that the gaming system will provide that player with at least the common outcome when the predetermined time period associated with that bonus game identifier expires. Thus, a player of one of these embodiments may either: (a) place earned or received player identifiers on a variety of different bonus game identifiers such that the gaming system provides the player with the common outcomes associated with those bonus game identifiers when their respective predetermined time periods expire, or (b) place earned or received player identifiers on a small quantity (such as one or two) of the bonus game identifiers in an attempt to place the most player identifiers on those bonus game identifiers and guarantee that the gaming system provides the player with the premium outcomes associated with those bonus game identifiers when their respective predetermined time periods expire.

In various embodiments, the community selection game includes one or more upgrades that may be provided to a player or players. The gaming system displays one or more upgrade identifiers in the community selection game area. Each of the displayed upgrade identifiers identifies an upgrade. In these embodiments, the gaming system enables players to place earned or received player identifiers in association with one of the upgrade identifiers rather than placing the player identifier in association with one of the bonus game identifiers. When the gaming receives a player identifier from a player in one of the upgrade identifiers, the gaming system provides the player with the upgrade identified by that upgrade identifier. In general, each of the upgrades is an advantage that the player may utilize in the community selection game.

Additional features and advantages are described herein, and will be apparent from, the following Detailed Description and the Figures.

DETAILED DESCRIPTION

Gaming Device and Electronics

The present disclosure may be implemented in various configurations for gaming machines, gaming devices, or gaming systems, including but not limited to: (1) a dedicated gaming machine, gaming device, or gaming system wherein the computerized instructions for controlling any games (that are provided by the gaming machine or gaming device) are provided with the gaming machine or gaming device prior to delivery to a gaming establishment; and (2) a changeable gaming machine, gaming device, or gaming system wherein the computerized instructions for controlling any games (that are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces), and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling the base or primary game of the present disclosure are communicated from the central server to the gaming device in a thick client configuration and computerized instructions for controlling any secondary or bonus games or functions are executed by a central server in a thin client configuration.

Figure 1A:
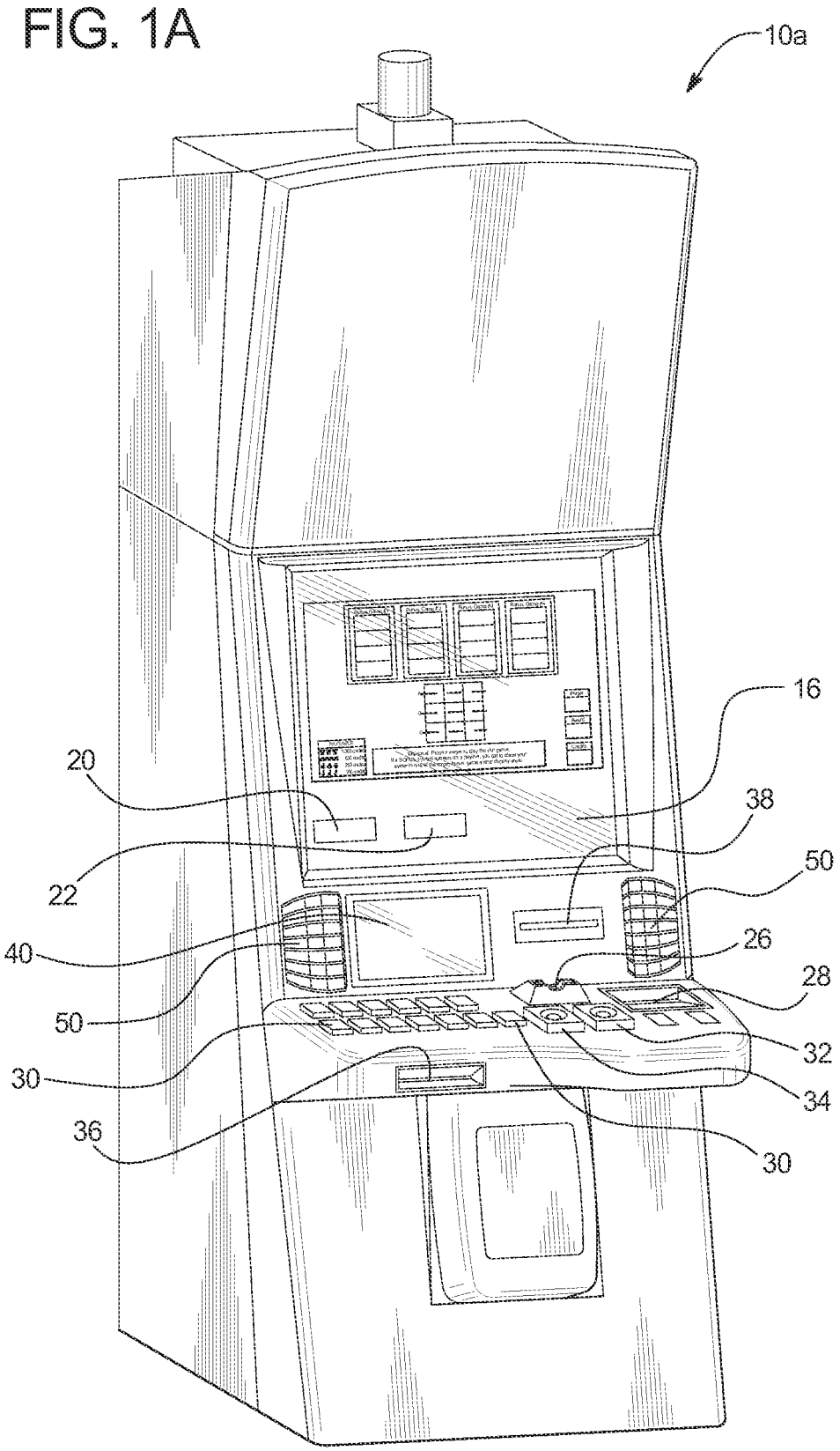
FIGS. 1A and 1B are perspective views of example alternative embodiments of a gaming device of the gaming system of the present disclosure.
Figure 1B:
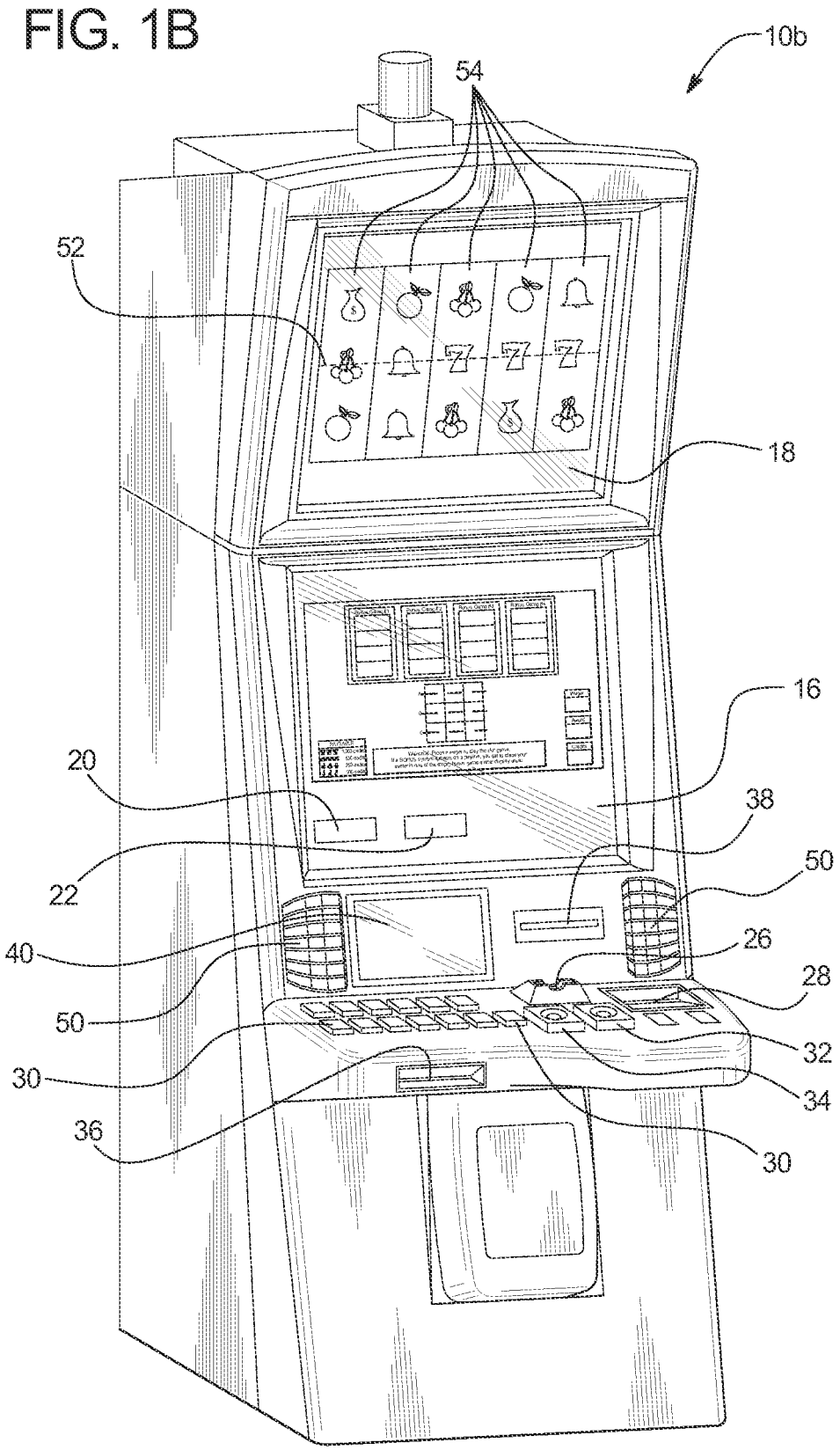

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet that provides support for a plurality of displays, inputs, controls, and other features of a conventional gaming machine. It is configured so that a player may operate it while standing or sitting. The gaming device may be positioned on a base or stand or may be configured as a pub-style table-top game (nor shown) that a player may operate preferably while sitting. As illustrated by the different configurations shown in FIGS. 1A and 1B, the gaming device may have varying cabinet and display configurations.

Figure 2A:
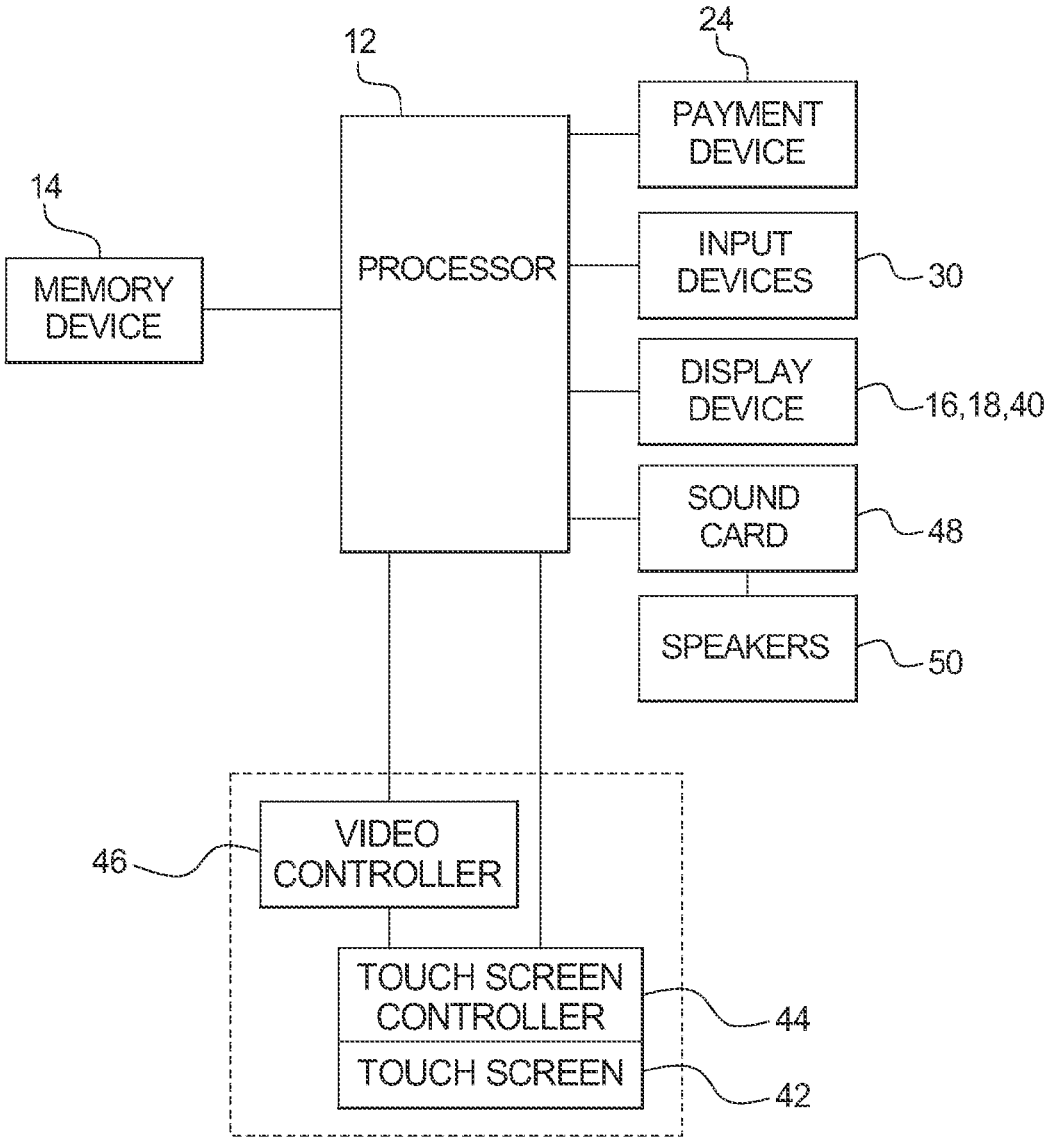
FIG. 2A is a schematic block diagram of one embodiment of an electronic configuration for one of the gaming devices of the gaming system disclosed herein.

In one embodiment, as illustrated in FIG. 2A, the gaming device includes at least one processor 12, such as a microprocessor, a microcontroller-based platform, a suitable integrated circuit, or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, paytable data or information, and applicable game rules that relate to the play of the gaming device. In one embodiment, the memory device includes random access memory (RAM), which may include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above may be stored in a detachable or removable memory device, such as, but not limited to, a suitable cartridge, disk, CD ROM, DVD, non-transitory computer readable medium, or USB memory device. In other embodiments, part or all of the program code and/or operating data described above may be downloaded to the memory device through a suitable network.

In one embodiment, an operator or a player may use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, such as part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller,"

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 that displays any suitable base or primary game. This display device may also display any suitable secondary or bonus game associated with the base or primary game as well as information relating to the base or primary game or the secondary or bonus game. The alternative embodiment shown in FIG. 1B includes a central display device 16 and an upper display device 18. The upper display device may display the base or primary game, any suitable secondary or bonus game associated or not associated with the base or primary game, and/or information relating to the base or primary game or the secondary or bonus game. These display devices may also serve as digital glass operable to advertise games or other aspects of the gaming establishment. As shown in FIGS. 1A and 1B, in one embodiment, the gaming device includes a credit display 20 that displays a player's current number of credits, cash, account balance, or the equivalent. In one embodiment, the gaming device includes a bet display 22 that displays a player's amount wagered. In one embodiment, as discussed in more detail below, the gaming device includes a player tracking display 40 that displays information regarding a player's play tracking status.

In another embodiment, at least one display device may be a mobile display device, such as a PDA or tablet PC, that enables play of at least a portion of the base or primary game or the secondary or bonus game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as discussed in more detail below, the display device includes a touch-screen with an associated touch-screen controller. The display devices may be of any suitable size and configuration, such as a square, a rectangle, or an elongated rectangle.

The display devices of the gaming device are configured to display at least one and preferably a plurality of game or other suitable images, symbols, and indicia such as any visual representation or exhibition of the movement of objects such as mechanical, virtual, or video reels and wheels; dynamic lighting; video images; images of people, characters, places, things, or faces of cards; and the like.

In one alternative embodiment, the symbols, images, and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As shown in FIGS. 1A and 1B, a payment device such as a payment acceptor includes a note, ticket, or bill acceptor 28, into which the player inserts paper money, a ticket, or voucher and a coin slot 26 into which the player inserts money, coins, or tokens. In other embodiments, payment devices such as readers or validators for credit cards, debit cards, or credit slips may accept payment. In one embodiment, a player may insert an identification card into a card reader of the gaming device. In one embodiment, the identification card is a smart card having a programmed microchip, a coded magnetic strip, or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, that communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as discussed above.

As shown in FIGS. 1A, 1B, and 2A, in one embodiment the gaming device includes at least one and preferably a plurality of input devices 30 in communication with the processor. The input devices may include any suitable device that enables the player to produce an input signal that is received by the processor. In one embodiment, after appropriate funding of the gaming device, the input device is a game activation device, such as a play button 32 or a pull arm (not shown) that is used by the player to start the base or primary game or sequence of events in the gaming device. The play button may be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player may increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) that enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as shown in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player may make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as shown in FIG. 2A, the gaming device includes a sound generating device controlled by one or more sound cards 48 that function in conjunction with the processor. In one embodiment, the sound generating device includes at least one and preferably a plurality of speakers 50 or other sound generating hardware and/or software for generating sounds, such as by playing music for the base or primary game and/or the secondary or bonus game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera and to display the visible manifestation of the game in split screen or picture-in-picture fashion. For example, the camera may acquire an image of the player and the processor may incorporate that image into the base or primary game and/or the secondary or bonus game as a game image, symbol, or indicia.

Gaming device 10 incorporates the base or primary game and any secondary or bonus game associated with the base or primary game. The gaming machine or device may include some or all of the features of conventional gaming machines or devices. The gaming device may incorporate any suitable reel-type game, card game, cascading or falling symbol game, number game, or other game of chance susceptible to representation in an electronic or electromechanical form as a secondary or bonus game or feature, which in one embodiment produces a random outcome based on probability data at the time of or after placement of a wager. That is, different base or primary games or secondary or bonus games, such as video poker games, video blackjack games, video keno games, and video bingo games may be implemented.

In one embodiment, the base or primary game and/or the secondary or bonus game includes one or more paylines 52 associated with a plurality of symbol display positions. The paylines may be horizontal, vertical, circular, diagonal, angled, or any combination thereof. In this embodiment, the gaming device includes at least one and preferably a plurality of reels 54, such as three to five reels, in either electromechanical form with mechanical rotating reels or video form with simulated reels and movement thereof. In one embodiment, an electromechanical slot machine includes a plurality of adjacent, rotatable reels that may be combined and operably coupled with an electronic display of any suitable type. In another embodiment, if the reels are in video form, one or more of the display devices, as discussed above, displays the plurality of simulated video reels. Each reel displays a plurality of indicia or symbols, such as bells, hearts, fruits, numbers, letters, bars, or other images that preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels stop spinning if specified types and/or configurations of indicia or symbols occur on an active payline or otherwise occur in a winning pattern, occur on the requisite number of adjacent reels, and/or occur in a scatter pay arrangement.

In an alternative embodiment, rather than determining any outcome to provide to the player by analyzing the symbols generated on any wagered upon paylines as discussed above, the gaming device determines any outcome to provide to the player based on the number of associated symbols that are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if a reel is activated based on the player's wager, then each of the symbol positions of that reel will be activated and each of the active symbol positions will be part of one or more of the ways to win. In one embodiment, if a reel is not activated based on the player's wager, then a designated number of default symbol positions, such as a single symbol position of the middle row of the reel, will be activated and the default symbol position(s) will be part of one or more of the ways to win. This type of gaming machine enables a player to wager on one, more than one, or all of the reels, and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as discussed above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as discussed above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols that form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as discussed above for each of the remaining classified strings of related symbols that were previously classified or formed from related symbols on the first and second reels.

After analyzing each of the remaining strings of related symbols, the gaming device determines, for each remaining pending or incomplete string of related symbols, if any of the symbols from the next adjacent reel should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, base or primary game or the secondary or bonus game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table that utilizes conventional poker hand rankings to determine the winning hands. The gaming device provides the player with an award based on a winning hand and the number of credits the player wagered.

In another embodiment, the base or primary game or the secondary or bonus game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, the base or primary game or the secondary or bonus game may be a keno game wherein the gaming device displays a plurality of selectable indicia or numbers on at least one of the display devices. In this embodiment, the player selects at least one of a plurality of the selectable indicia or numbers via an input device such as a touch screen. The gaming device then displays a series of drawn numbers and determines an amount of matches, if any, between the player's selected numbers and the gaming device's drawn numbers. The player is provided an award based on the amount of matches, if any, based on the amount of determined matches and the number of numbers drawn.

In one embodiment, as noted above, in addition to winning credits or other awards in the base or primary game, the gaming device may also give players the opportunity to win credits in a secondary or bonus game or in a secondary or bonus round. The secondary or bonus game enables the player to obtain a prize or payout in addition to the prize or payout, if any, obtained from the base or primary game. In general, a secondary or bonus game produces a significantly higher level of player excitement than the base or primary game because it provides a greater expectation of winning than the base or primary game, and is accompanied with more attractive or unusual features than the base or primary game. In one embodiment, the secondary or bonus game may be any type of suitable game, either similar to or completely different from the base or primary game.

In one embodiment, the triggering event or qualifying condition may be a selected outcome in the base or primary game or a particular arrangement of one or more indicia on a display device in the base or primary game, such as a BONUS symbol appearing on three adjacent reels along a payline in the base or primary game. In other embodiments, the triggering event or qualifying condition occurs based on exceeding a certain amount of game play (such as number of games, number of credits, amount of time), or reaching a specified number of points earned during game play.

In another embodiment, gaming device processor 12 or central controller 56 randomly provides the player one or more plays of one or more secondary or bonus games. In one such embodiment, the gaming device does not provide any apparent reason to the player for qualifying to play a secondary or bonus game. In this embodiment, qualifying for a secondary or bonus game is not triggered by an event in or based specifically on any of the plays of the base or primary game. That is, the gaming device may simply qualify a player to play a secondary or bonus game without any explanation or alternatively with simple explanations. In another embodiment, the gaming device (or central server) qualifies a player for a secondary or bonus game at least partially based on a game triggered or symbol triggered event, such as at least partially based on the play of the base or primary game.

In one embodiment, the gaming device includes a program that will automatically begin a secondary or bonus round after the player has achieved a triggering event or qualifying condition in the base or primary game. In another embodiment, after a player has qualified for a secondary or bonus game, the player may subsequently enhance the player's secondary or bonus game participation through continued play of the base or primary game. Thus, for each secondary or bonus qualifying event, such as a bonus symbol, that the player obtains, a given number of secondary or bonus game wagering points or credits may be accumulated in a "bonus meter" programmed to accrue the secondary or bonus wagering credits or entries toward eventual participation in a secondary or bonus game. The occurrence of multiple such secondary or bonus qualifying events in the base or primary game may result in an arithmetic or exponential increase in the number of secondary or bonus wagering credits awarded. In one embodiment, the player may redeem extra secondary or bonus wagering credits during the secondary or bonus game to extend play of the secondary or bonus game.

In one embodiment, no separate entry fee or buy-in for a secondary or bonus game is needed. That is, a player may not purchase entry into a secondary or bonus game; rather, the player must win or earn entry through play of the base or primary game, thus encouraging play of the base or primary game. In another embodiment, qualification of the secondary or bonus game is accomplished through a simple "buy-in" by the player—for example, if the player has been unsuccessful at qualifying through other specified activities. In another embodiment, the player must make a separate side-wager on the secondary or bonus game or wager a designated amount in the base or primary game to qualify for the secondary or bonus game. In this embodiment, the secondary or bonus game triggering event must occur and the side-wager (or designated base or primary game wager amount) must have been placed to trigger the secondary or bonus game.

Figure 2B:
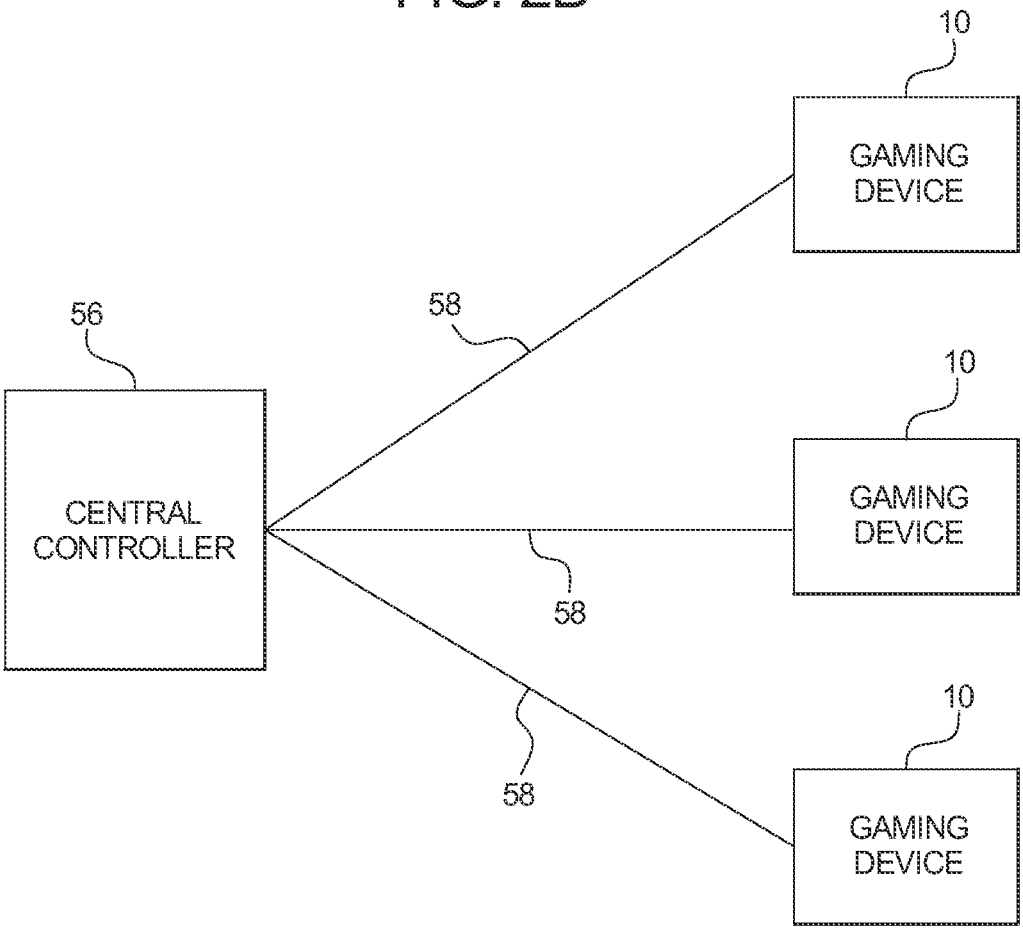
FIG. 2B is a schematic block diagram of one embodiment of a network configuration for a plurality of gaming devices of the gaming system disclosed herein.

In one embodiment, as illustrated in FIG. 2B, one or more of gaming devices 10 are in communication with each other and/or at least one central controller 56 through a data network or remote communication link 58. In this embodiment, the central server, central controller, or remote host is any suitable server or computing device that includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more, or each of the functions of the central controller, central server, or remote host as disclosed herein may be performed by one or more gaming device processors. It should be further appreciated that one, more, or each of the functions of one or more gaming device processors as disclosed herein may be performed by the central controller, central server, or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the base or primary game based on probability data. In another embodiment, the central server or controller randomly generates a game outcome for the secondary or bonus game based on probability data. In another embodiment, the central server or controller randomly generates a game outcome for both the base or primary game and the secondary or bonus game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome may include a base or primary game outcome, a secondary or bonus game outcome, base or primary game and secondary or bonus game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control may assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno, or lottery game is not displayed to the player, but the results of the bingo, keno, or lottery game determine the predetermined game outcome value for the base or primary game or the secondary or bonus game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination may be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As discussed above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10, which will be provided to a first player regardless of how the first player plays in a first game, and a second gaming device to have selected elements marked in a different predetermined pattern is provided a second outcome of win $2, which will be provided to a second player regardless of how the second player plays a second game. It should be appreciated that as the process of marking selected elements continues until one or more predetermined patterns are marked, this embodiment ensures that at least one bingo card will win the bingo game, and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as discussed above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as discussed above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card that has an encoded player identification number that uniquely identifies the player. When a player inserts the player's playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes the player's player tracking card when concluding play for that gaming session. In another embodiment, rather than requiring a player to insert a player tracking card, the gaming device utilizes one or more portable devices carried by a player, such as a cell phone, a radio frequency identification tag, or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) that are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device may be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as discussed above, one or more gaming devices are in communication with a central server or controller. The central server or controller may be any suitable server or computing device that includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game that may be played on one or more of the gaming devices in the gaming system. Such different games may include the same or substantially the same game play with different pay tables. In different embodiments, the executable game program is for the base or primary game, a secondary or bonus game, or both. In another embodiment, the game program may be executable as a secondary or bonus game to be played simultaneous with the play of the base or primary game (that may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate the base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of the base or primary game. That is, a player is provided a progressive award without any explanation or, alternatively, with simple explanations. In another embodiment, a player is provided a progressive award at least partially based on a game triggered or symbol triggered event, such as at least partially based on the play of the base or primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager any credit amount during the base or primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the base or primary game of the gaming machines in the gaming system, via a gaming establishment or via any suitable manner.

In another embodiment, one or more of the progressive awards are partially funded via a side-bet or side-wager that the player may make (and that may be tracked via a side-bet meter). In one embodiment, one or more of the progressive awards are funded with only side-bets or side-wagers placed. In another embodiment, one or more of the progressive awards are funded based on players' wagers as discussed above as well as any side-bets or side-wagers placed.

In one alternative embodiment, a minimum wager level is required for a gaming device to qualify to be selected to obtain one of the progressive awards. In one embodiment, this minimum wager level is the maximum wager level for the base or primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, among the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Community Selection Game Providing Bonus Game Selection

Various embodiments of the present disclosure provide a gaming system and method providing a multi-player or community selection game providing bonus game selection. In certain embodiments, the gaming system includes a plurality of gaming devices, each of which is configured to display and operate one or more primary wagering games upon the placement of one or more wagers by a player. For each of the gaming devices, when a triggering event occurs, the gaming system provides the player of that gaming device with one or more player identifiers that uniquely identify that player. Each of the gaming devices of the gaming system is configured to operate a community selection game in which each player may use any player identifiers earned or received by that player. In other words, the players of the gaming devices are all able to participate in the same community selection game using their respective earned or received player identifiers. In general, the players compete against one another to gain entry into one or more bonus or secondary games (referred to herein as bonus games) represented by bonus game identifiers displayed in a community game selection area of the community selection game. It should be appreciated that the bonus game identifiers may take any suitable form. In one example, the gaming system displays the community selection game as a "town" and the bonus game identifiers as "buildings" within the "town."

In certain embodiments, the bonus game identifiers each include a limited quantity of bonus game player identifier display areas. The gaming system enables the players to place earned or received player identifiers at the bonus game player identifier display areas. More specifically, in these embodiments, when a player playing one of the gaming devices earns or receives a player identifier, the gaming system enables the player to select one of the bonus game player identifier display areas that does not already display a player identifier. The gaming system then displays the player's player identifier at the selected bonus game player identifier display area. Thus, when a player earns or receives a player identifier, the gaming system enables the player to "place" that player identifier in an empty one of the bonus game player identifier display areas. When each bonus game player identifier display area of one of the displayed bonus game identifiers displays a player identifier, the players associated with those player identifiers are provided with one or more plays of the bonus game identified by that bonus game identifier.

Therefore, in these embodiments, once the gaming system receives a player identifier from a player in one of the bonus game player identifier display areas associated with one of the bonus game identifiers, it is guaranteed that the gaming system will provide that player with one or more plays of the bonus game identified by that bonus game identifier when that bonus game is triggered. In other words, it is guaranteed that the gaming system will provide that player with one or more plays of that bonus game when each of the bonus game player identifier display areas associated with that bonus game identifier displays a player identifier. These embodiments of the gaming system thus enable players to compete to place earned or received player identifiers in the limited quantity of bonus game player identifier display areas associated with the bonus game identifiers to be provided with one or more plays of the bonus games identified by those bonus game identifiers.

Thus, in these embodiments, it should be appreciated that the gaming system enables multiple players playing multiple gaming devices to simultaneously participate in the same community selection game. Each of the players earns or receives player identifiers during play of that player's respective gaming device, and the gaming system enables each of the players to place those player identifiers in empty bonus game player identifier display areas. Whenever each of the bonus game player identifier display areas of one of the bonus game identifiers displays one of the player identifiers, the gaming system provides the players associated with those displayed player identifiers with one or more plays of the bonus game identified by that bonus game identifier.

It should be appreciated that, in this embodiment, more than one of the bonus game player identifier display areas of a given bonus game identifier may each display a player identifier of one of the players. For example, if the gaming system provides a player with two player identifiers and if two bonus game player identifier display areas of a given bonus game identifier do not display a player identifier, the gaming system enables the player to place one of the player identifiers in one of the empty bonus game player identifier display areas and the other player identifier in the other empty bonus game player identifier display area. When the player does so and the bonus game is triggered, the gaming system provides the player with a multiplier for use in at least one of the plays of the bonus game provided to the player. In one embodiment, the multiplier is equal to the quantity of player identifiers placed by the player in bonus game player identifier display areas associated with the bonus game identifier. Thus, in the above example, the gaming system provides the player with a 2× multiplier for the plays of the bonus game the gaming system provides to the player because the gaming system received a player identifier from the player in two of the bonus game player identifier display areas associated with the given bonus game identifier.

It should be appreciated that in other embodiments the multiplier is not equal to the quantity of player identifiers placed by the player in bonus game player identifier display areas associated with the given bonus game identifier. For example, in one embodiment the multiplier incrementally increases by a certain quantity, such as two (or any suitable quantity), for each player identifier added to bonus game player identifier display areas associated with the given bonus game identifier. This incentivizes a player to place a large quantity of the player's player identifiers in bonus game player identifier display areas of the given one of the bonus game identifiers because doing so will enable the player to dramatically increase (via large multiplier values) any awards provided to the player during play of the bonus game. In another embodiment, the multiplier incrementally increases once for every two player identifiers added to bonus game player identifier display areas of the given bonus game identifier. In this embodiment, the inclusion of the multiplier option does not unduly increase the overall average expected payback percentage of the overall game (i.e., the average expected payback percentage of the combination of the primary game and the bonus games). In certain embodiments, the multiplier may have a maximum value (e.g., a "cap") that it cannot exceed, regardless of the quantity of player identifiers a player has placed in bonus game player identifier display areas of a given one of the bonus game identifiers.

It should be appreciated that the player identifier provided to each player uniquely identifies that player. Put differently, the player identifier provided to each player differentiates that player from the players of the other gaming devices in the gaming system and, in some embodiments, from all other past, current, or future players of the gaming system. In certain embodiments, for each of the players, the gaming system provides that player with the same player identifier whenever the triggering event occurs. In other embodiments, the gaming system provides each player with one of a plurality of different player identifiers upon the occurrence of the triggering event as long as each of those player identifiers uniquely identifies that player.

It should be appreciated that the triggering event may be any suitable triggering event. In certain embodiments in which the primary game is a spinning reel-type game, such as the embodiments described below with respect to FIGS. 4A, 4B, 4C, 4D, 4E, 5A, 5B, 5C, and 5D, the triggering event occurs when a predetermined symbol or combination of symbols is displayed on the reels or along a wagered-on payline associated with the reels. In various other embodiments, the triggering event is based on one or more of: (i) an amount of time played on the gaming system; (ii) a random time of the day; (iii) an amount of money wagered on the gaming system; (iv) an amount of money lost at the gaming system; (v) an amount of money won at the gaming system; (vi) an amount of money wagered on the gaming devices in the gaming system; (vii) an amount of money lost on the gaming devices in the gaming system; (viii) an amount of money won on the gaming devices in the gaming system; (ix) an event or outcome occurring in the primary game of one of the gaming devices in the gaming system; (x) an event occurring due to a shared random outcome generation; (xi) meeting one or more thresholds, such as a number of plays or a wager pool exceeding a designated amount; (xii) a random determination based on an amount wagered; (xiii) an occurrence of a predetermined event; (xiv) one or more side wagers being placed; and (xv) any suitable combination of these.

In some embodiments, the gaming system includes a plurality of different triggering events, each of which is associated with a different quantity of player identifiers. In these embodiments, when one of the plurality of triggering events occurs, the gaming system provides the player with the quantity of player identifiers associated with that triggering event. In some embodiments, triggering events associated with relatively large quantities of player identifiers are rarer (i.e., occur less often) than triggering events associated with relatively small quantities of player identifiers. In other embodiments, the gaming system provides the player with a quantity of player identifiers based on the player's wager in the primary game. In these embodiments, for example, when the triggering event occurs, if the player placed the maximum wager the gaming system provides the player with a larger quantity of player identifiers than if the player placed the minimum wager.

It should be appreciated that, in various embodiments, players may earn or receive player identifiers in any suitable manner in addition to or instead of earning or receiving player identifiers via the triggering event. In one embodiment, the gaming system enables players to purchase player identifiers by paying a fee or placing an additional wager on a play of the primary game. In other embodiments, player identifiers are provided to players based on information stored in a player tracking profile of the players. For example, the gaming system may provide players with player identifiers when the players have reached certain milestones, such as a threshold of time spent playing the gaming system or a threshold of quantities of plays of the primary game. In other embodiments, player identifiers are provided to players based on a wager or wagers placed by players.

Figure 3A:
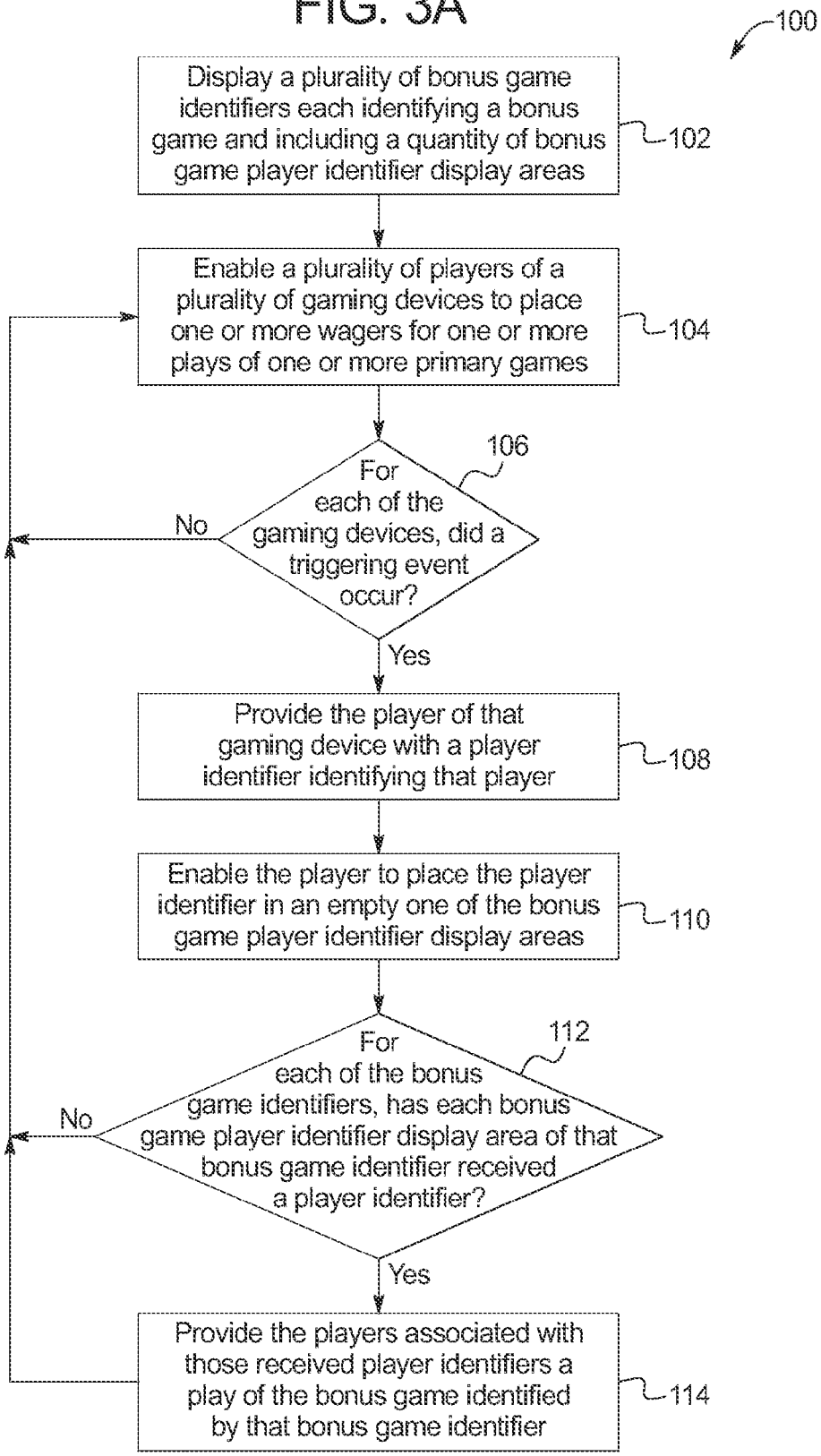
FIG. 3A is a flowchart illustrating an example method of operating a gaming system of one embodiment of the present disclosure in which bonus game identifiers each include a limited quantity of bonus game player identifier display areas.

FIG. 3A illustrates a flowchart of a example of a process or method 100 for operating one of the above-described embodiments of the gaming system of the present disclosure. In one embodiment, this process 100 is represented by a set of instructions stored in one or more memories and executed by one or more processors or controllers. Although this process 100 is described with reference to the flowchart shown in FIG. 3A, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In operation of one embodiment, the gaming system displays a plurality of bonus game identifiers, as indicated by block 102. Each of the bonus game identifiers identifies a bonus game and includes a quantity of bonus game player identifier display areas. The gaming system enables a plurality of players of a plurality of gaming devices to place one or more wagers for one or more plays of one or more primary games, as indicated by block 104. The gaming system determines, for each of the gaming devices, whether a triggering event has occurred, as indicated by diamond 106. If the triggering event has not occurred, the process returns to block 104.

If the triggering event has occurred, the gaming system provides the player of that gaming device with a player identifier identifying that player, as indicated by block 108. The gaming system receives the player identifier in an empty one of the bonus game player identifier display areas, as indicated by block 110. The gaming system determines, for each of the bonus game identifiers, whether each bonus game player identifier display area of that bonus game identifier has received a player identifier, as indicated by diamond 112. If at least one of the bonus game player identifier display areas of that bonus game identifier is empty (i.e., has not received and does not display a player identifier), the process returns to block 104. If each of the bonus game player identifier display areas of that bonus game identifier has received (i.e., displays) a player identifier, the gaming system provides the players associated with those player identifiers with a play of the bonus game identified by that bonus game identifier, as indicated by block 114. The process returns to block 104.

FIGS. 4A, 4B, 4C, 4D, and 4E illustrate screen shots of an example of one of these embodiments of the gaming system and method of the present disclosure. In this embodiment, the gaming system includes four gaming devices configured to operate one or more primary wagering games, though it should be appreciated that the gaming system may include any suitable number of gaming devices. This example embodiment is described below with respect to a first one of the gaming devices (the "first gaming device") played by a first one of the players (the "first player"). In this example, the primary wagering game of the first gaming device is a spinning reel-type wagering game (referred to herein as the "primary game"). The primary game includes a plurality of symbols including a BONUS symbol. In this embodiment, when the BONUS symbol is generated and displayed along a wagered-on payline, the player is provided with one player identifier to place in one of a plurality of empty bonus game player identifier display areas, as generally discussed above and as explained below with respect to this illustrated example. That is, in this embodiment, the triggering event occurs when the BONUS symbol is generated and displayed along a wagered-on payline.

In this embodiment, a display device 120 of the first gaming device adjacently displays symbol display areas 130*a*, 130*b*, 130*c*, 130*d*, 130*e*, 130*f*, 130*g*, 130*h*, and 130*i* of the primary game in a 3×3 grid or matrix. Display device 120 displays a plurality of paylines for the primary game, each of which is associated with a different plurality of the symbol display areas. Specifically, payline A 132*a* is associated with symbol display areas 130*a*, 130*b*, and 130*c*; payline B 132*b* is associated with symbol display areas 130*d*, 130*e*, and 130*f*; and payline C 132*c* is associated with symbol display areas 130*g*, 130*h*, and 130*i*. For clarity and brevity, payline A 132*a*, payline B 132*b*, and payline C 132*c* are sometimes referred to herein as paylines A, B, and C.

Display device 120 displays a paytable 122 for the primary game that includes a plurality of winning symbol combinations. Paytable 122 indicates the credit payout associated with each respective winning symbol combination. In this illustrated embodiment, paytable 122 indicates the credit payout associated with each respective winning symbol combination when the maximum wager for the primary game, which is 10 credits in this embodiment, is placed by a player for a play of the primary game. More specifically, winning symbol combination SEVEN-SEVEN-SEVEN is associated with an award of 1,000 credits; winning symbol combination BAR-BAR-BAR is associated with an award of 500 credits; winning symbol combination TRIPLE CHERRY-TRIPLE CHERRY-TRIPLE CHERRY is associated with an award of 250 credits; and winning symbol combination CHERRY-CHERRY-CHERRY is associated with an award of 100 credits.

Display device 120 displays an indication or notification box 121, which displays information and/or messages before, during, or after play; a wager indicator or display 124, which indicates any wager placed by the player for a play of the primary game; an award indicator or display 126, which indicates any award a player has won during a play of the primary game or any bonus games; and a credit meter 128, which indicates the player's credit balance. While the player's credit balance, the player's wager, and any awards are displayed as an amount of monetary credits or currency in this example, one or more of such player's credit balance, such player's wager, and any awards provided to such player may be for non-monetary credits, promotional credits, and/or player tracking points or credits.

It should be appreciated that, in various embodiments: (a) the display device may display any suitable quantity of symbol display areas in any suitable configuration or arrangement; (b) the display device may display any suitable quantity of paylines; (c) each of the displayed paylines may be associated with any suitable quantity of the symbol display areas; (d) each of the displayed paylines may be associated with any suitable combination of the symbol display areas; (e) the paytable may be modified to reflect lower credit payouts when a wager that is less than the maximum wager is placed by the player for a play of the primary game; (f) any suitable paytable including any suitable quantity of winning symbol combinations may be used for the primary game; (g) any suitable combinations of the symbols may be used as winning symbol combinations for the primary game; (h) the winning symbol combinations may be associated with any suitable credit payouts for the primary game; (i) any suitable quantity of paytables may be used for the primary game; and (j) any suitable symbols may be used for the primary game, such as letters, numbers, illustrations or pictures of objects, or any other suitable markings or indicia.

Display device 120 also displays a community selection game area 150. Community selection game area 150 includes a first bonus game identifier 152, which identifies a first bonus game; a second bonus game identifier 154, which identifies a second bonus game; a third bonus game identifier 156, which identifies a third bonus game; and a fourth bonus game identifier 158, which identifies a fourth bonus game. In this embodiment, each bonus game identifier includes a designated quantity of bonus game player identifier display areas, each of which is configured to display a player identifier associated with a player. Specifically, first bonus game identifier 152 includes first bonus game player identifier display areas 152*a*, 152*b*, 152*c*, and 152*d*; second bonus game identifier 154 includes second bonus game player identifier display areas 154*a*, 154*b*, 154*c*, and 154*d*; third bonus game identifier 156 includes third bonus game player identifier display areas 156*a*, 156*b*, 156*c*, and 156*d*; and fourth bonus game identifier 158 includes fourth bonus game player identifier display areas 158*a*, 158*b*, 158*c*, and 158*d*. It should be appreciated that the community selection game may include any suitable quantity of bonus game identifiers, that the bonus game identifiers may include any suitable quantity of bonus game player identifier display areas, and that at least two of the bonus game identifiers may include different quantities of bonus game player identifier display areas.

Figure 4A:
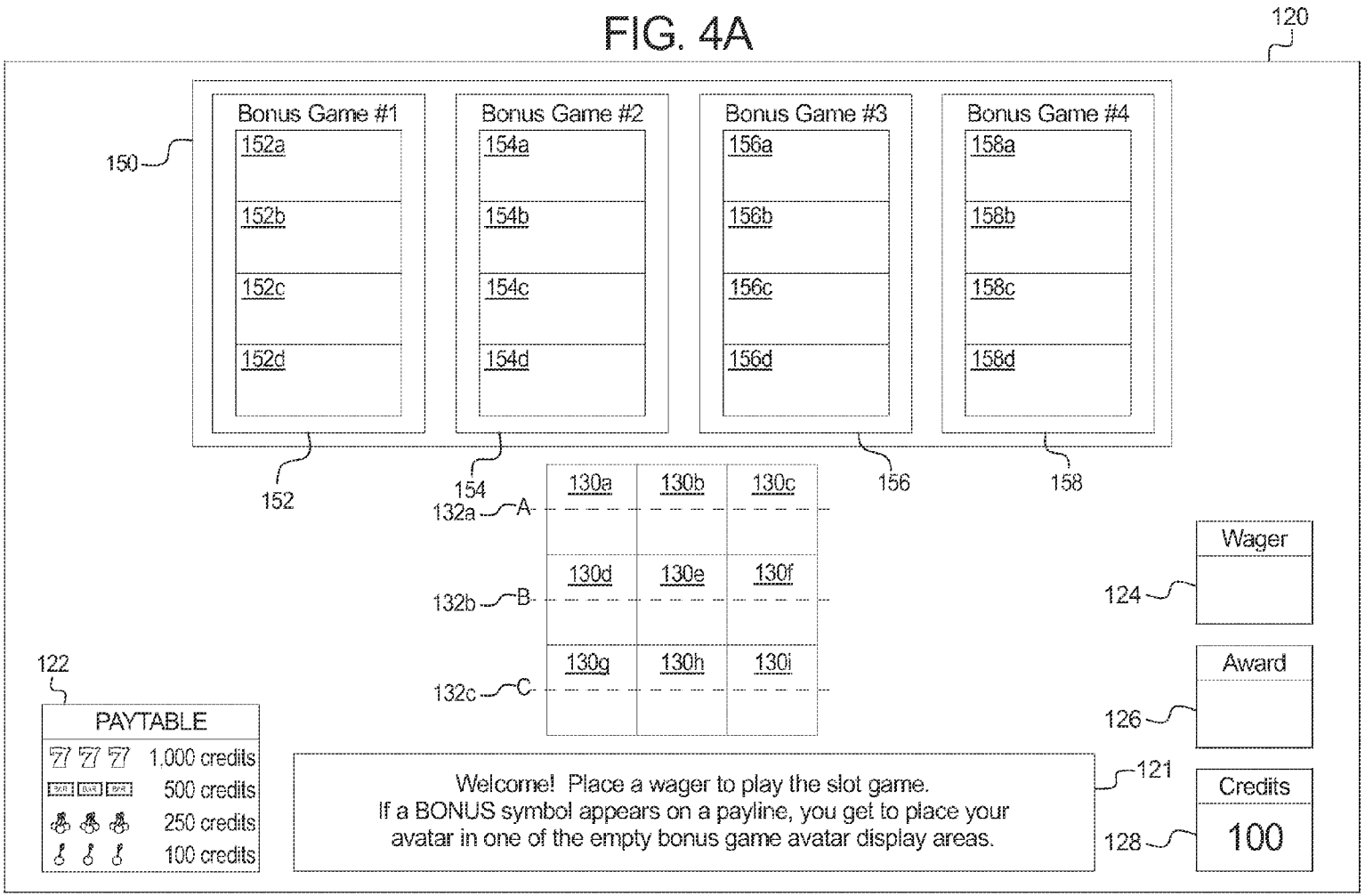
FIGS. 4A, 4B, 4C, 4D, and 4E are front views of a display device of a gaming device of the gaming system of one embodiment of the present disclosure, and illustrate a plurality of consecutive example plays of one embodiment of the primary game and the community selection game providing bonus game selection in which bonus game identifiers each include a limited quantity of bonus game player identifier display areas.

As illustrated in FIG. 4A, when a player is not playing the first one of the gaming devices, display device 120 displays a notification in indication box 121 that invites a player to place a wager on a play of the primary game. In this embodiment, the first player deposits currency and is provided with 100 credits, which are shown in credit meter 128.

Figure 4B:
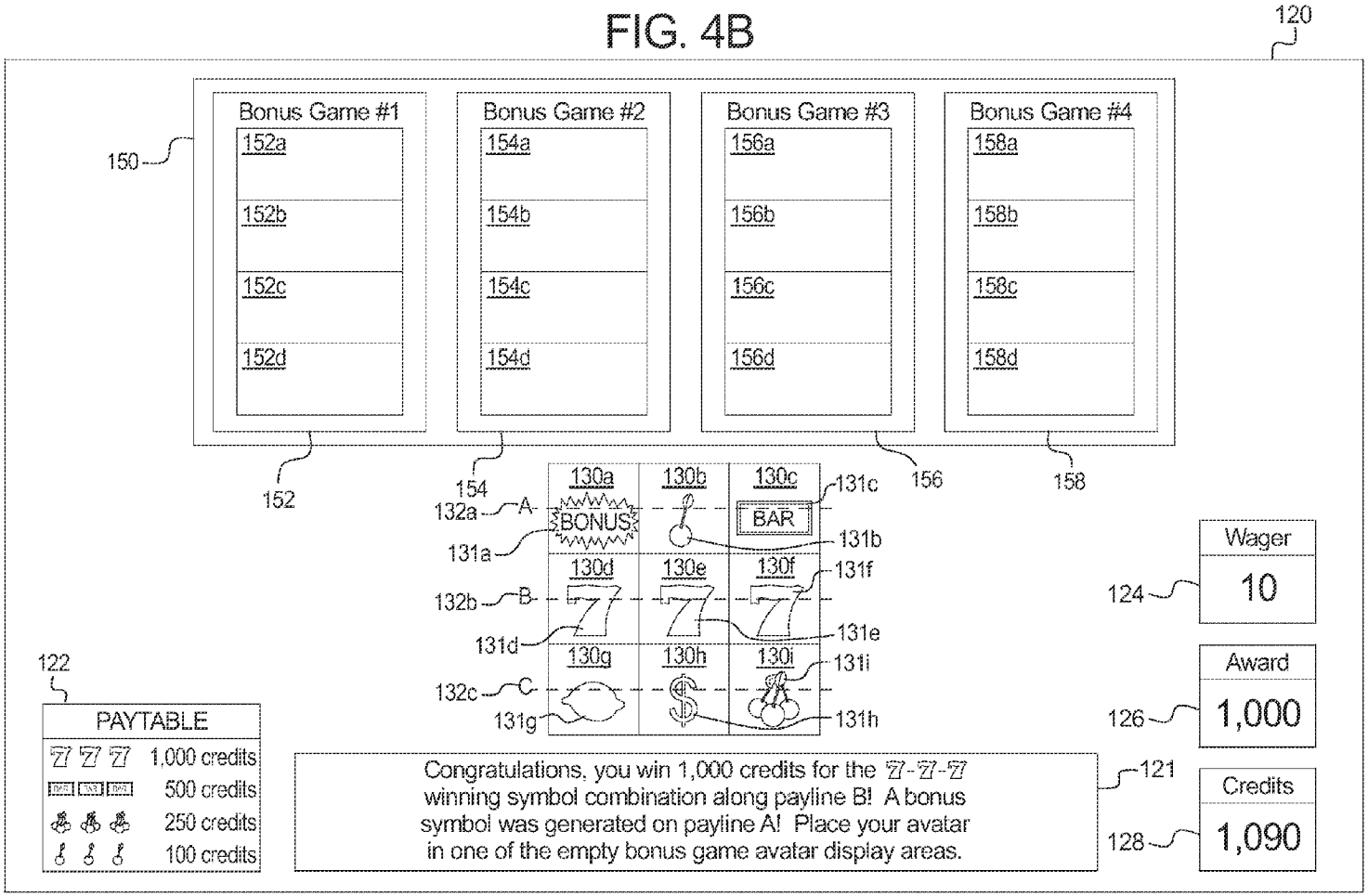

As illustrated in FIG. 4B, the first player initiates a play of the primary game on the first gaming device by placing a wager on one or more of paylines A, B, and C. In this example, the first player places the maximum wager of 10 credits, which activates each of paylines A, B, and C. The first player's wager of 10 credits is indicated in wager indicator 124. Symbols 131*a*, 131*b*, 131*c*, 131*d*, 131*e*, 131*f*, 131*g*, 131*h*, and 131*i* are generated and displayed at symbol display areas 130*a*, 130*b*, 130*c*, 130*d*, 130*e*, 130*f*, 130*g*, 130*h*, and 130*i*, respectively. Only payline B is associated with a winning symbol combination in this example. Specifically, symbol display areas 130*d*, 130*e*, and 130*f* along payline B each display SEVEN symbols 131*d*, 131*e*, and 131*f*, respectively. As indicated in paytable 122, the player wins an award of 1,000 credits for the displayed SEVEN-SEVEN-SEVEN winning symbol combination, and the award is displayed in award indicator 126. The first player's credit balance displayed in credit meter 128 increases to 1,090 credits, which reflects the first player's initial credit balance of 100 credits minus the first player's wager of 10 credits plus the first player's award of 1,000 credits.

BONUS symbol 131*a* was generated and displayed at symbol display area 130*a* along wagered-on payline A. Accordingly, the gaming system provides the first player with a first player identifier (i.e., a player identifier that uniquely identifies the first player) and enables the first player to place that first player identifier in one of first bonus game player identifier display areas 152*a* to 152*d*, one of second bonus game player identifier display areas 154*a* to 154*d*, one of third bonus game player identifier display areas 156*a* to 156*d*, or one of fourth bonus game player identifier display areas 158*a* to 158*d*. It should be appreciated that, since at this point no player identifiers are displayed at any of the bonus game player identifier display areas, the gaming system enables the first player to place the first player identifier in any of the bonus game player identifier display areas.

Figure 4C:
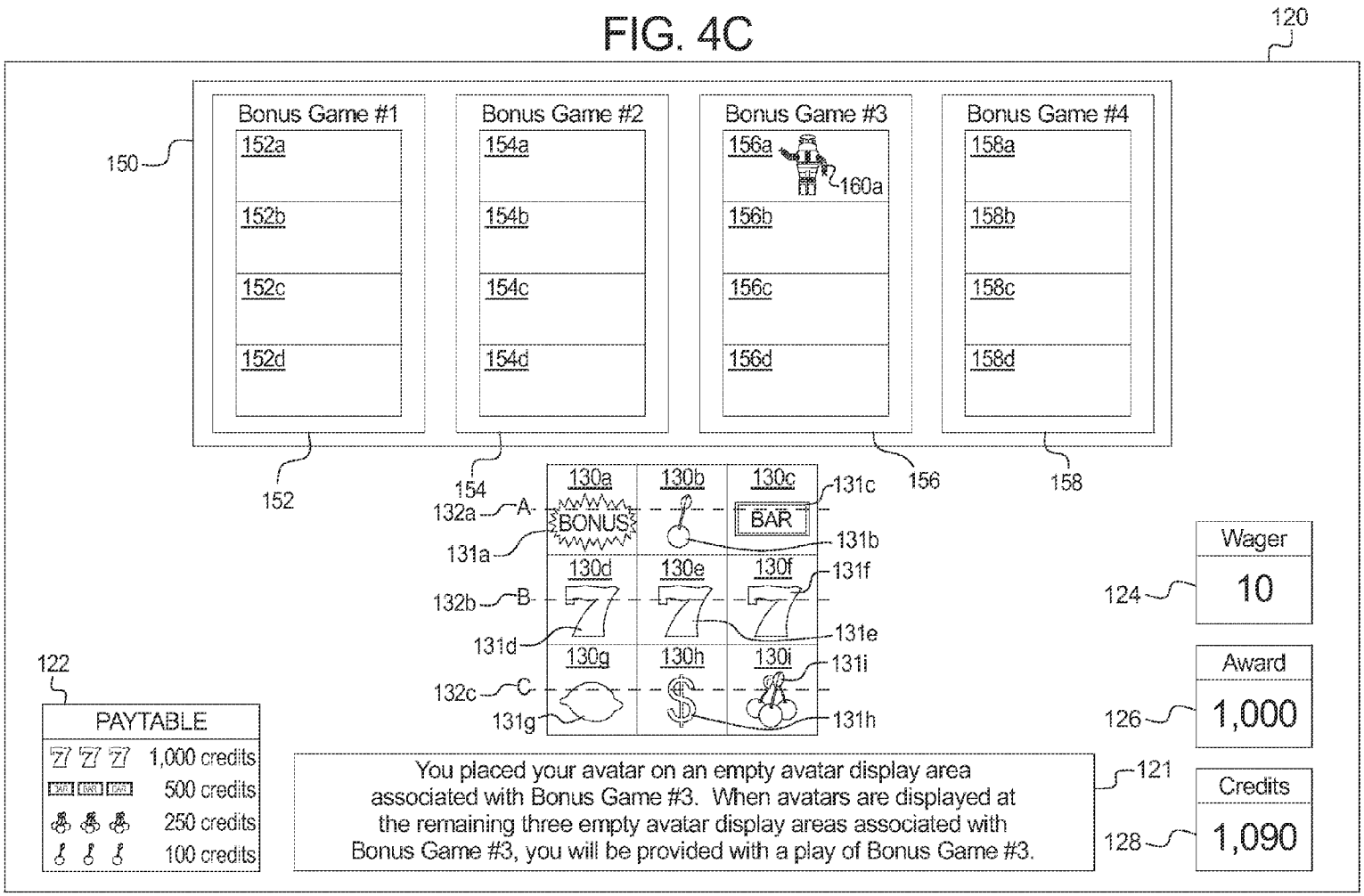
Figure 4D:
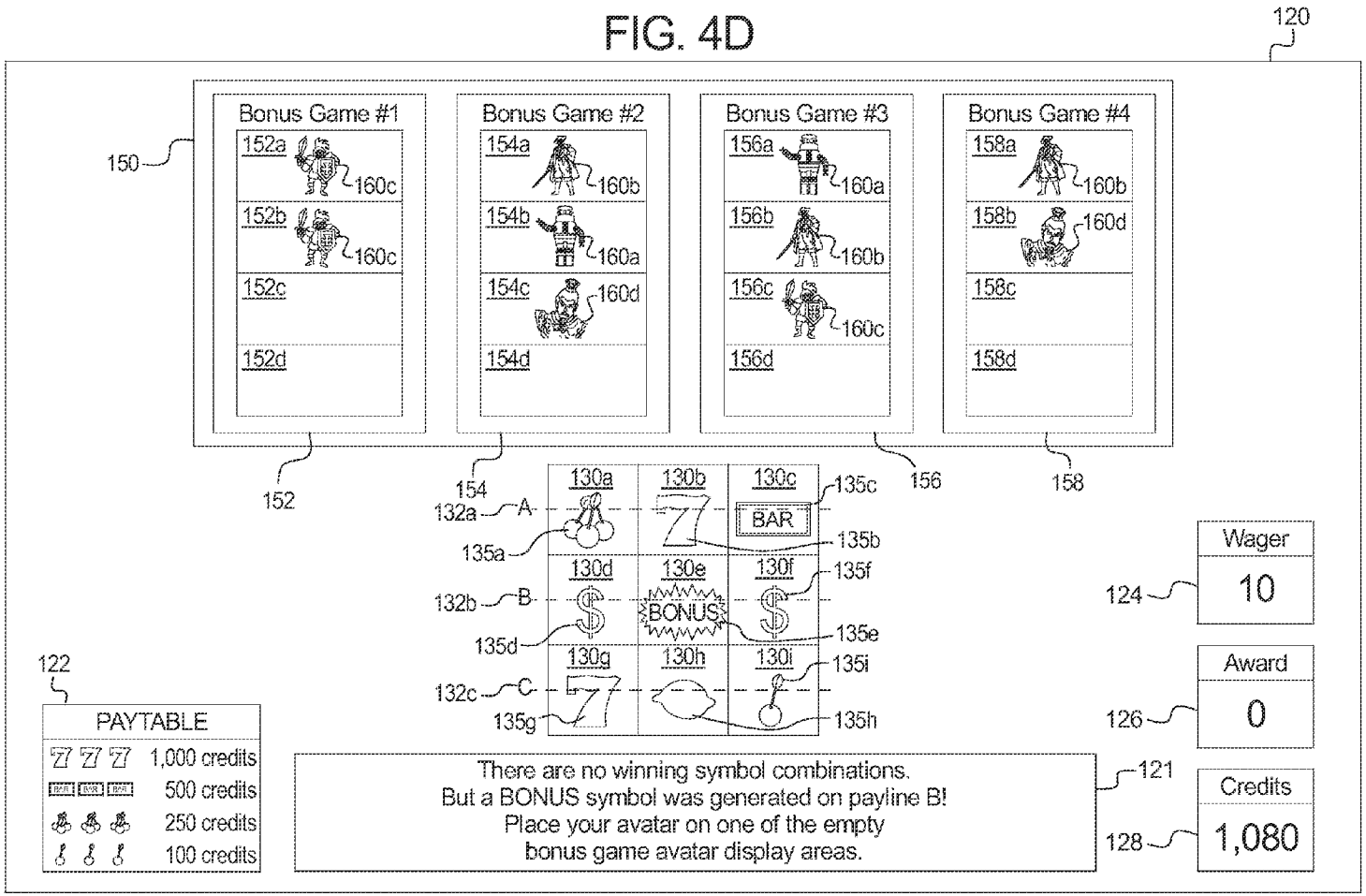

As illustrated in FIG. 4C, after providing the first player with first player identifier 160*a*, the gaming system enables the first player to select one of the empty bonus game player identifier display areas at which to display first player identifier 160*a* (i.e., one of the bonus game player identifier display areas at which a player identifier is not currently displayed). In this example, the gaming system receives a selection of third bonus game player identifier display area 156*a* from the first player, and the gaining system displays first player identifier 160*a* at third bonus game player identifier display area 156*a*. In other words, the first player placed first player identifier 160*a* in third bonus game player identifier display area 156*a*. In this example embodiment, first player identifier 160*a* is a robot avatar. It should be appreciated that the robot avatar uniquely identifies the first player so as to distinguish the first player from the other players of the other gaming devices of the gaming system.

At a subsequent point in time during which a plurality of players played the gaming devices of the gaming system, as illustrated in FIG. 40, a plurality of the bonus game player identifier display areas in addition to third bonus game player identifier display area 156*a* each displays a player identifier associated with a player of one of the gaming devices of the gaming system. Specifically, first bonus game player identifier display area 152*a* displays a third player identifier 160*c*, first bonus game player identifier display area 152*b* displays third player identifier 160*c*, second bonus game player identifier display area 154*a* displays a second player identifier 160*b*, second bonus game player identifier display area 154*b* displays first player identifier 160*a*, second bonus game player identifier display area 154*c* displays a fourth player identifier 160*d*, third bonus game player identifier display area 156*b* displays second player identifier 160*b*, third bonus game player identifier display area 156*c* displays third player identifier 160*c*, fourth bonus game player identifier display area 158*a* displays second player identifier 160*b*, and fourth bonus game player identifier display area 158*b* displays fourth player identifier 160*d*.

The first player initiates another play of the primary game by placing the maximum wager of 10 credits, which activates each of paylines A, B, and C. The first player's wager of 10 credits is indicated in wager indicator 124. Symbols 135*a*, 135*b*, 135*c*, 135*d*, 135*e*, 135*f*, 135*g*, 135*h*, and 135*i* are generated and displayed at symbol display areas 130*a*, 130*b*, 130*c*, 130*d*, 130*e*, 130*f*, 130*g*, 130*h*, and 130*i*, respectively. None of the paylines are associated with a winning symbol combination in this example. The first player's credit balance displayed in credit meter 128 decreases to 1,080 credits, which reflects the first player's initial credit balance of 1,090 credits minus the first player's wager of 10 credits.

BONUS symbol 135*e* was generated and displayed at symbol display area 130*e* along wagered-on payline B. Thus, the gaming system provides the first player with another first player identifier 160*a* and enables the first player to place that first player identifier in an empty one of first bonus game player identifier display areas 152*c* or 152*d*, empty second bonus game player identifier display area 154*d*, empty third bonus game player identifier display area 156*d*, or an empty one of fourth bonus game player identifier display areas 158*c* and 158*d*.

Figure 4E:
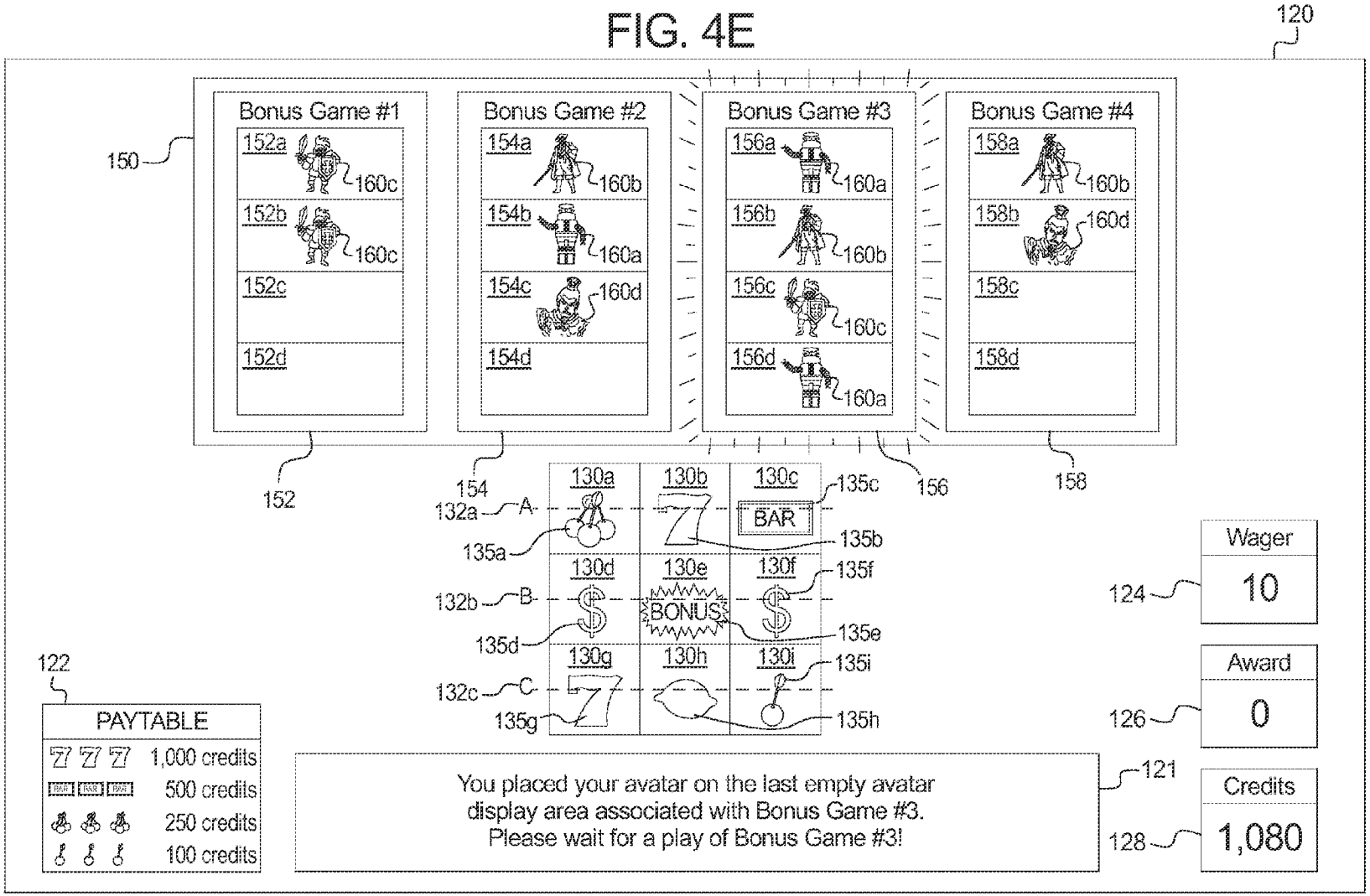

As illustrated in FIG. 4E, in this example the gaming system receives a selection of third bonus game player identifier display area 156*d* from the first player, and the gaming system displays first player identifier 160*a* at third bonus game player identifier display area 156*a*. After the first player places first player identifier 160*a* in third bonus game player identifier display area 156*d*, each of third bonus game player identifier display areas 156*a* to 156*d* associated with third bonus game identifier 156 display a player identifier. Specifically, third bonus game player identifier display areas 156*a* and 156*d* display first player identifier 160*a*, third bonus game player identifier display area 156*b* displays second player identifier 160*b*, and third bonus game player identifier display area 156*c* displays third player identifier 160*c*. In this embodiment, once each of the bonus game player identifier display areas of one of the bonus game identifiers displays a player identifier, the gaming system provides the players associated with one of those displayed player identifiers with a play of the bonus game identified by that bonus game identifier. In other words, the gaming system notifies those players that they will receive a play of that bonus game and provides each of those players with a play of that bonus game.

The gaming system also determines whether to provide any of those players with a multiplier during play of the bonus game. In this embodiment, the gaming system provides a player with a multiplier if more than one of the bonus game player identifier display areas of that bonus game identifier display the player's player identifier. Thus, in this example, after displaying first player identifier 160*a* at third bonus game player identifier display area 156*d*, the gaming system: (a) provides the first player with a play of the third bonus game with a 2× multiplier (because a first player identifier 160*a* was displayed at each of two third bonus game player identifier display areas); (b) provides the second player (i.e., the player associated with second player identifier 160*b*) with a play of the third bonus game without a multiplier (because fewer than two second player identifiers were displayed at the third bonus game player identifier display areas); and (c) provides the third player (i.e., the player associated with third player identifier 160*c*) with a play of the third bonus game without a multiplier (because fewer than two third player identifiers were displayed at the third bonus game player identifier display areas).

In various other embodiments, the displayed bonus game identifiers are each configured to accommodate an unlimited quantity of player identifiers rather than a limited quantity of player identifiers. Put differently, in these embodiments, the bonus game identifiers do not each include a limited quantity of bonus game player identifier display areas at which the gaming system may display player identifiers. Instead, for each bonus game identifier, the gaming system enables players to place an unlimited quantity of earned or received player identifiers in association with that bonus game identifier. The gaming system tracks and displays the quantity of player identifiers that each player has placed in association with each bonus game identifier.

In certain of these embodiments, each of the bonus game identifiers is associated with: (a) a predetermined time period; (b) a common outcome that, in some embodiments, is one or more plays of the bonus game identified by that bonus game identifier; and (c) a premium outcome that, in some embodiments, is one or more plays of the bonus game identified by that bonus game identifier that is more advantageous to players than the common outcome. In these embodiments, for each bonus game identifier, the gaming system enables players to place earned or received player identifiers in association with that bonus game identifier during the predetermined time period associated with that bonus game identifier. Upon the expiration of that predetermined time period, the gaming system determines which player placed the highest quantity of player identifiers in association with that bonus game identifier during that predetermined time period. The gaming system provides the player who placed the highest quantity of player identifiers in association with that bonus game identifier during that predetermined time period with the premium outcome. The gaming system provides each of the other players who placed one or more player identifiers in association with that bonus game identifier during that predetermined time period with the common outcome.

It should be appreciated that, in these embodiments, once a player places a player identifier in association with one of the bonus game identifiers, it is guaranteed that the gaming system will provide that player with at least the common outcome when the predetermined time period associated with that bonus game identifier expires. Thus, a player of one of these embodiments of the gaming system may either: (a) place earned or received player identifiers in association with a variety of different bonus game identifiers such that the gaming system provides the player with the common outcomes associated with those bonus game identifiers when their respective predetermined time periods expire, or (b) place earned or received player identifiers in association with a small quantity (such as one or two) of the bonus game identifiers in an attempt to place the most player identifiers on those bonus game identifiers and guarantee that the gaming system provides the player with the premium outcomes associated with those bonus game identifiers when their respective predetermined time periods expire. That is, certain players may try to collect as many guaranteed common outcomes as possible, while others may compete to achieve the premium outcome at the risk of not achieving the premium outcome and being provided with a small quantity of common outcomes.

Figure 3B:
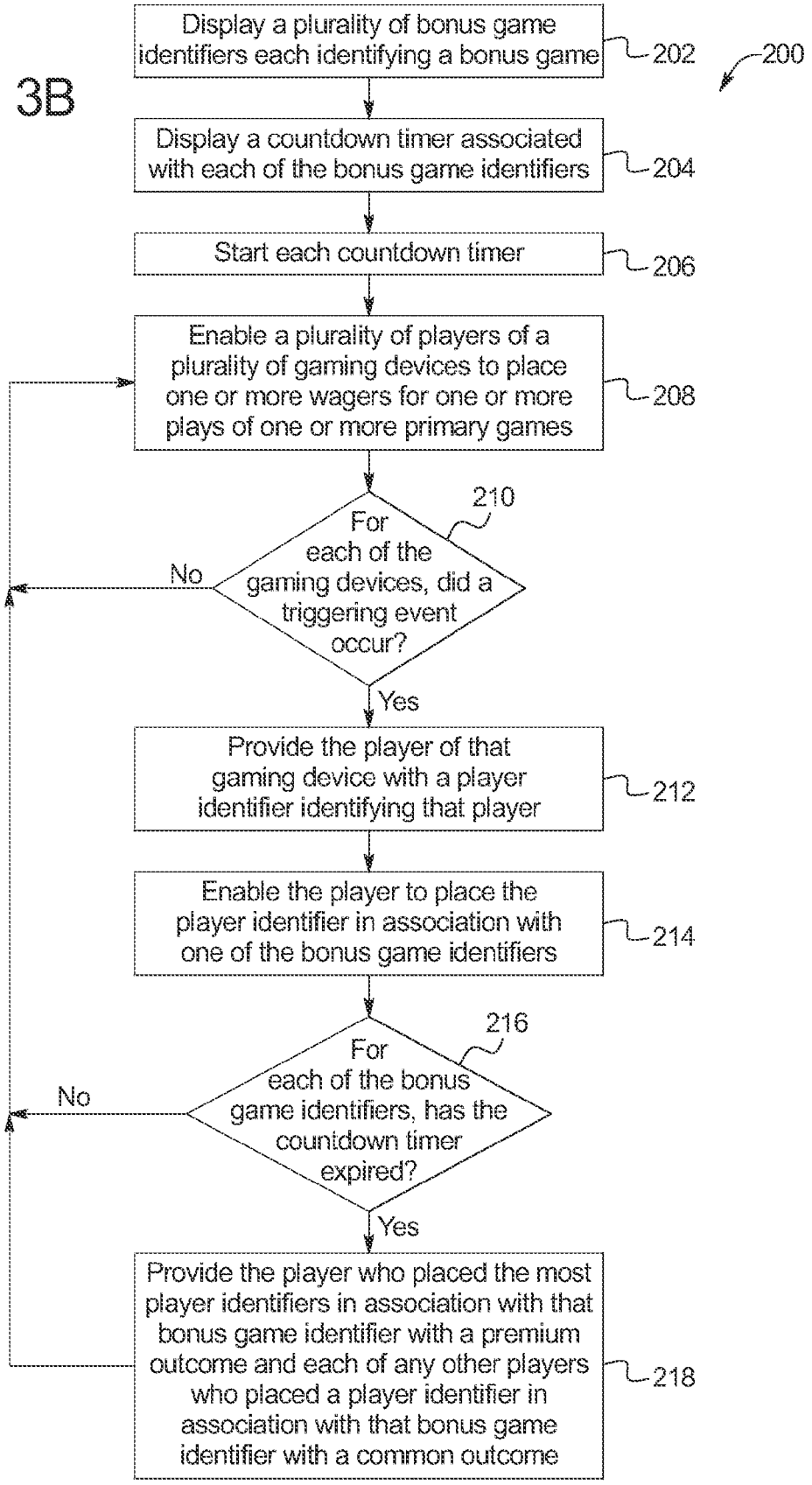
FIG. 3B is a flowchart illustrating an example method of operating a gaming system of another embodiment of the present disclosure in which bonus game identifiers are each active for a predetermined time period and configured to be associated with an unlimited quantity of player identifiers.

FIG. 3B illustrates a flowchart of one example of a process or method 200 for operating one of the above-described embodiments of the gaming system of the present disclosure. In one embodiment, this process 200 is represented by a set of instructions stored in one or more memories and executed by one or more processors or controllers. Although this process 200 is described with reference to the flowchart shown in FIG. 3B, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In operation of one embodiment, the gaming system displays a plurality of bonus game identifiers, as indicated by block 202. Each of the bonus game identifiers identifies a bonus game. The gaming system displays a countdown timer associated with each of the bonus game identifiers, as indicated by block 204. Each countdown timer displays a predetermined time period. The gaming system starts each of the countdown timers, as indicated by block 206. The gaming system enables a plurality of players of a plurality of gaming devices to place one or more wagers for one or more plays of one or more primary games, as indicated by block 208. The gaming system determines, for each of the gaming devices, whether a triggering event has occurred, as indicated by diamond 210. If the triggering event has not occurred, the process returns to block 208.

If the triggering event has occurred, the gaming system provides the player of that gaming device with a player identifier identifying that player, as indicated by block 212. The gaming system receives the player identifier in association with one of the bonus game identifiers for which the predetermined time period has not expired, as indicated by block 214. The gaming system determines, for each of the bonus game identifiers, whether the countdown timer has expired, as indicated by diamond 216. If the countdown timer has not expired, the process returns to block 208. If the countdown timer has expired, the gaming system provides the player who placed the most player identifiers in association with that bonus game identifier with a premium outcome and provides each of any other players who placed a player identifier in association with that bonus game identifier with a common outcome, as indicated by block 218. The process returns to block 208.

FIGS. 5A, 5B, 5C, and 50 illustrate screen shots of an example of one of these embodiments of the gaming system and method of the present disclosure. In this embodiment, the gaming system includes four gaming devices configured to operate one or more primary wagering games. This example embodiment is described below with respect to a first one of the gaming devices (the "first gaming device") played by a first one of the players (the "first player"). In this example, the primary wagering game of the first gaming device is a spinning reel-type wagering game (referred to herein as the "primary game"). The primary game includes a plurality of symbols including a BONUS symbol. In this embodiment, when the BONUS symbol is generated and displayed along a wagered-on payline, the player is provided with a player identifier to place in association with one of a plurality of bonus game identifiers, as generally discussed above and as explained below with respect to this illustrated example.

In this embodiment, a display device 220 of the first gaming device adjacently displays symbol display areas 230*a*, 230*b*, 230*c*, 230*d*, 230*e*, 230*f*, 230*g*, 230*h*, and 230*i* of the primary game in a 3×3 grid or matrix. Display device 220 displays a plurality of paylines for the primary game, each of which is associated with a different plurality of the symbol display areas. Specifically, payline A 232*a* is associated with symbol display areas 230*a*, 230*b*, and 230*c*; payline B 232*b* is associated with symbol display areas 230*d*, 230*e*, and 230*f*; and payline C 232*c* is associated with symbol display areas 230*g*, 230*h*; and 230*i*. For clarity and brevity, payline A 232*a*, payline B 232*b*, and payline C 232*c* are sometimes referred to herein as paylines A, B, and C.

Display device 220 displays a paytable 222 for the primary game that includes a plurality of winning symbol combinations. Paytable 222 indicates the credit payout associated with each respective winning symbol combination. In this illustrated embodiment, paytable 222 indicates the credit payout associated with each respective winning symbol combination when the maximum wager for the primary game, which is 10 credits in this embodiment, is placed by a player for a play of the primary game. More specifically, winning symbol combination SEVEN-SEVEN-SEVEN is associated with an award of 1,000 credits; winning symbol combination BAR-BAR-BAR is associated with an award of 500 credits; winning symbol combination TRIPLE CHERRY-TRIPLE CHERRY-TRIPLE CHERRY is associated with an award of 250 credits; and winning symbol combination CHERRY-CHERRY-CHERRY is associated with an award of 100 credits.

Display device 220 displays an indication or notification box 221, which displays information and/or messages before, during, or after play; a wager indicator or display 224, which indicates any wager placed by the player for a play of the primary game; an award indicator or display 226, which indicates any award a player has won during a play of the primary game; and a credit meter 228, which indicates the player's credit balance.

Display device 220 also displays a community selection game area 250. Community selection game area 250 includes a first bonus game identifier 252, which identifies a first bonus game; a second bonus game identifier 254, which identifies a second bonus game, a third bonus game identifier 256, which identifies a third bonus game, and a fourth bonus game identifier 258, which identifies a fourth bonus game. In this embodiment, each bonus game identifier is associated with a predetermined time period during which that bonus game identifier is active. In other words, for each bonus game identifier, the gaming system enables players to place player identifiers in association with that bonus game identifier during that predetermined time period. In this example, each of the bonus game identifiers includes a timer configured to display a countdown of the predetermined time period associated with that bonus game identifier. Specifically, first bonus game identifier 252 includes a first bonus game timer 252*a*, second bonus game identifier 254 includes a second bonus game timer 254*a*; third bonus game identifier 256 includes a third bonus game timer 256*a*, and fourth bonus game identifier 258 includes a fourth bonus game timer 258*a*. First bonus game timer 252*a* displays a predetermined time period of three minutes, second bonus game timer 254*a* displays a predetermined time period of five minutes, third bonus game timer 256*a* displays a predetermined time period of four minutes, and fourth bonus game timer 258*a* displays a predetermined time period of one minute and thirty seconds. It should be appreciated that the predetermined time period may be any suitable time period. It should also be appreciated that the predetermined time period may, in other embodiments, be randomly determined or determined by one or more players.

In some embodiments, the predetermined time periods are staggered such that certain of the predetermined time periods expire at different times. Thus, in these embodiments, players are provided with a decision as to whether to focus on earning bonus games associated with timers (i.e., predetermined time periods) that are expiring relatively soon, or whether to focus on earning bonus games with timers that are expiring relatively further in the future. It should be appreciated that, in general, a bonus game associated with a predetermined time period ending relatively soon is likely to have multiple players vying for the premium outcome, while a bonus game associated with a predetermined time period ending relatively further in the future is likely to have relatively fewer players vying for the premium outcome.

When the community selection game begins, one or more of the timers begin counting down. During play of the community selection game, the gaming system enables players place earned or received player identifiers in association with the bonus game identifiers during the predetermined time periods associated with the bonus game identifiers. Upon the expiration of the timer (i.e., of the predetermined time period) of one of the bonus game identifiers, the gaming system provides the player who placed the most player identifiers in association with that bonus game identifier with a premium outcome and each other player who placed a player identifier in association with that bonus game identifier with a common outcome. In this example embodiment, the premium outcome is four plays of the bonus game identified by that bonus game identifier, and the common outcome is one play of the bonus game identified by that bonus game identifier.

Figure 5A:
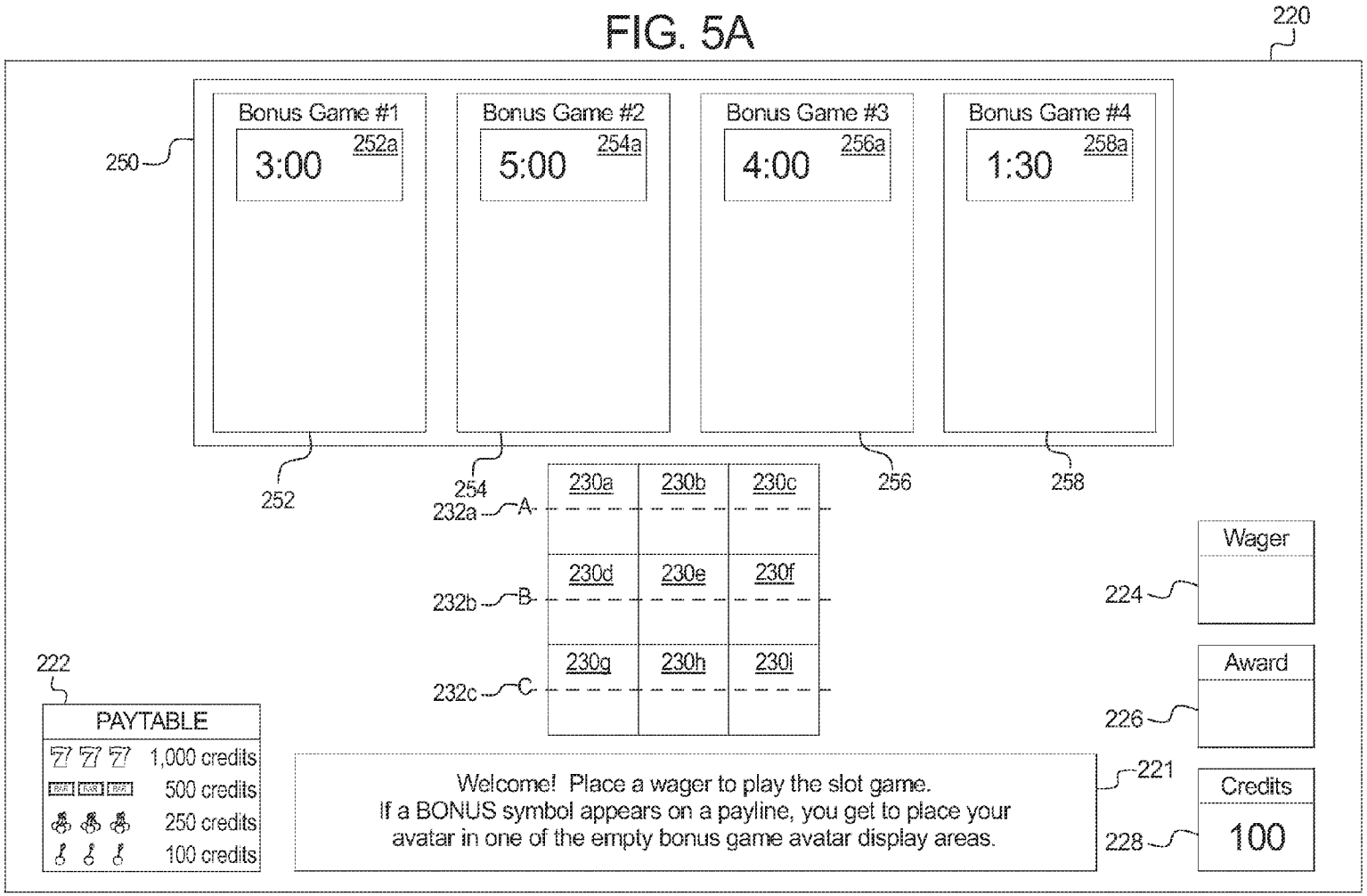
FIGS. 5A, 5B, 5C, and 5D are front views of a display device of a gaming device of the gaming system of another embodiment of the present disclosure, and illustrate a plurality of consecutive example plays of the primary game and the community selection game providing bonus game selection in which bonus game identifiers are each active for a predetermined time period and may be associated with an unlimited quantity of player identifiers.

As illustrated in FIG. 5A, when a player is not playing the first one of the gaming devices, display device 220 displays a notification in indication box 221 that invites a player to place a wager on a play of the primary game. In this embodiment, the first player deposits currency and is provided with 100 credits, which are shown in credit meter 228.

Figure 5B:
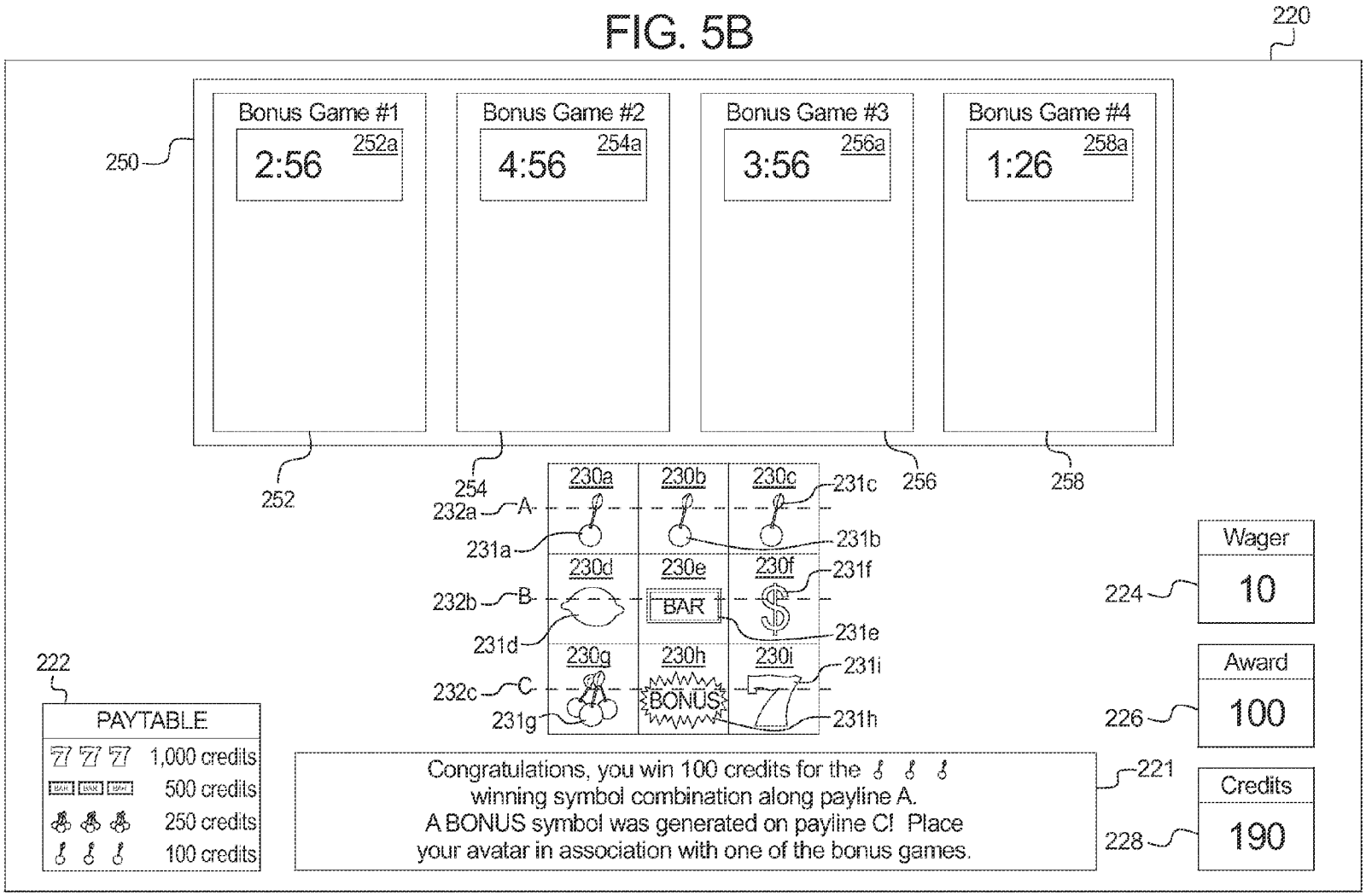

As illustrated in FIG. 5B, the first player initiates a play of the primary game on the first gaming device by placing a wager on one or more of paylines A, B, and C. In this example, the first player places the maximum wager of 10 credits, which activates each of paylines A, B, and C. The first player's wager of 10 credits is indicated in wager indicator 224. Symbols 231*a*, 231*b*, 231*c*, 231*d*, 231*e*, 231*f*, 231*g*, 231*h*, and 231*i* are generated and displayed at symbol display areas 230*a*, 230*b*, 230*c*, 230*d*, 230*e*, 230*f*, 230*g*, 230*h*, and 230*i*, respectively. Only payline A is associated with a winning symbol combination in this example. Specifically, symbol display areas 230*a*, 230*b*, and 230*c* along payline A each display CHERRY symbols 231*a*, 231*b*, and 231*c*, respectively. As indicated in paytable 222, the player wins an award of 100 credits for the displayed CHERRY-CHERRY-CHERRY winning symbol combination, and the award is displayed in award indicator 226. The first player's credit balance displayed in credit meter 228 increases to 190 credits, which reflects the first player's initial credit balance of 100 credits minus the first player's wager of 10 credits plus the first player's award of 100 credits. It should be appreciated that, in this example, each of the timers begin to count down when the first player begins play of the primary game on the first gaming device. It should be appreciated, however, that the timers may begin to count down at any suitable time, such as randomly, at predetermined intervals, or when one of the other players first initiates a play of the primary game.

BONUS symbol 231*h* was generated and displayed at symbol display area 230*h* along wagered-on payline C. Accordingly, the gaming system provides the first player with a first player identifier to place in association with one of first bonus game identifier 252, second bonus game identifier 254, third bonus game identifier 256, or fourth bonus game identifier 258.

Figure 5C:
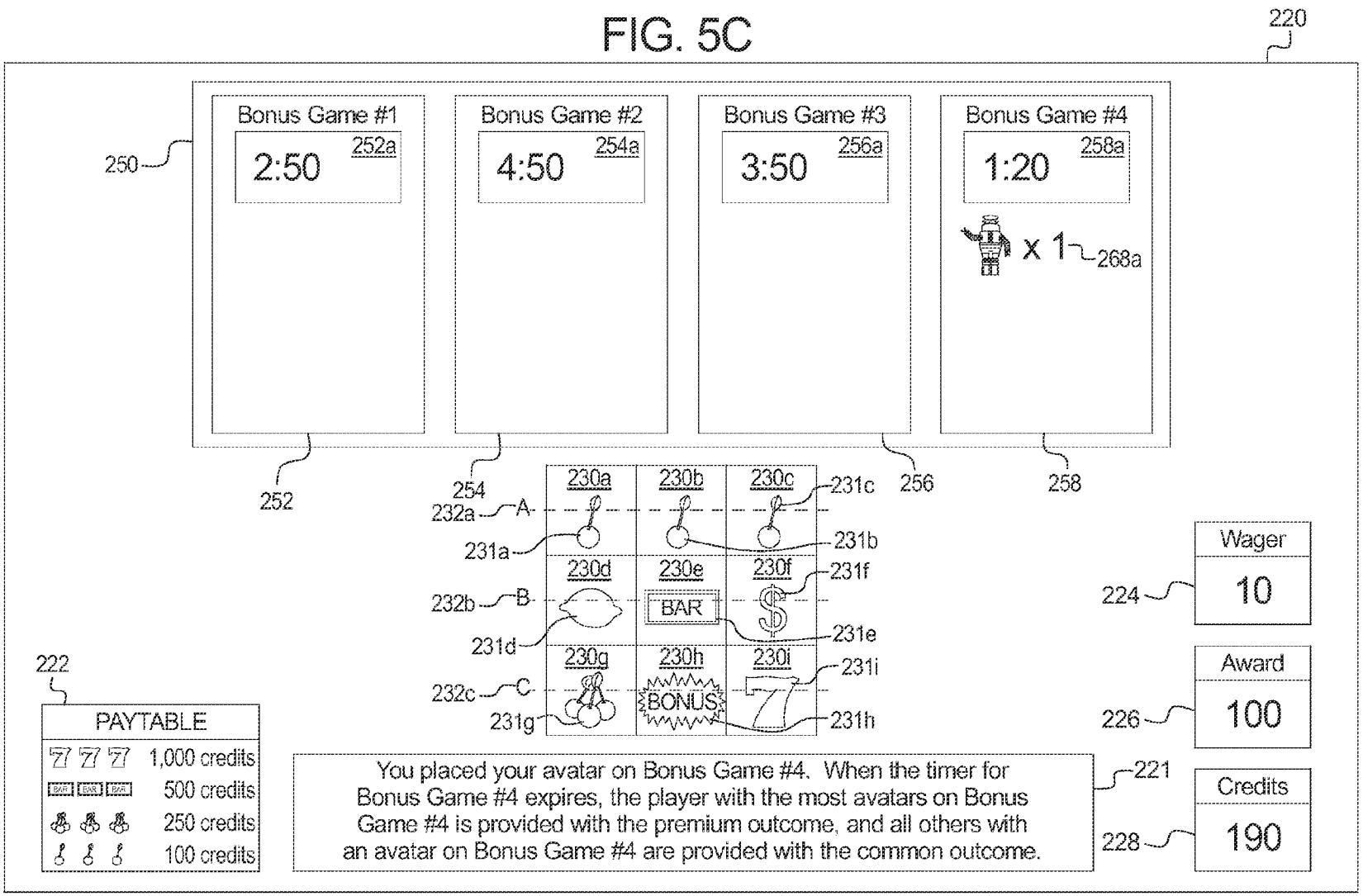

As illustrated in FIG. 5C, after providing the first player with the first player identifier, the gaming system enables the player to select one of the bonus game identifiers with which to associate the first player identifier. In this example, the gaming system receives a selection of fourth bonus game identifier 258 from the first player and displays the first player identifier at fourth bonus game identifier 258. In other words, the first player placed the first player identifier in association with fourth bonus game identifier 258. The gaming system displays a first player identifier counter 268*a* in fourth bonus game identifier 258. First player identifier counter 268*a* identifies the first player identifier and the quantity of first player identifiers the first player has placed in association with fourth bonus game identifier 258. Thus, in this example, first player identifier counter 268*a* identifies that the first player has placed one first player identifier in association with fourth bonus game identifier 258. In this example embodiment, the first player identifier is a robot avatar. It should be appreciated that the robot avatar uniquely identifies the first player so as to distinguish the first player from the other players of the other gaming devices of the gaming system.

Figure 5D:
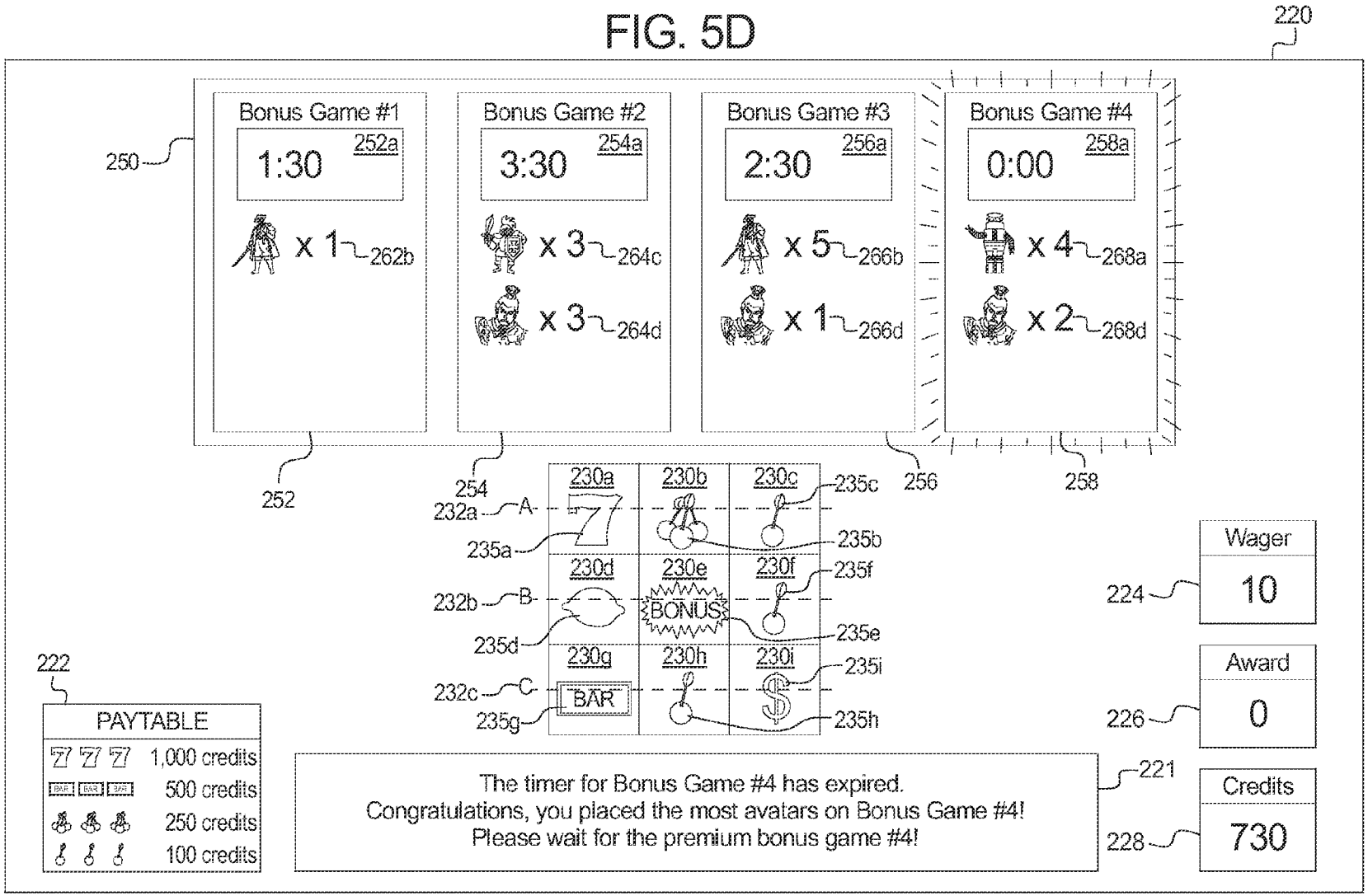

As illustrated in FIG. 5D, after one minute and thirty seconds have elapsed, the gaming system has received a plurality of player identifiers in association with a plurality of the bonus game identifiers from a plurality of players. Specifically, the gaming system received one second player identifier in association with first bonus game identifier 252 from the second player, as indicated by second player identifier counter 262*b*; the gaming system received three third player identifiers in association with second bonus game identifier 254 from the third player, as indicated by third player identifier counter 264*c*; the gaming system received three fourth player identifiers in association with second bonus game identifier 254 from the fourth player, as indicated by fourth player identifier counter 264*d*; the gaming system received player placed five second player identifiers in association with third bonus game identifier 256 from the second player, as indicated by third player identifier counter 266*b*; the gaming system received one fourth player identifier in association with third bonus game identifier 256 from the fourth player, as indicated by fourth player identifier counter 266*d*; the gaming system received three additional first player identifiers in association with fourth bonus game identifier 258 from the first player for a total of four placed first player identifiers, as indicated by first player identifier counter 268*a*; and the gaming system received two fourth player identifiers in association with fourth bonus game identifier 258 from the fourth player, as indicated by fourth player identifier counter 268*d*.

At this point, fourth bonus game timer 258*a* (i.e., the predetermined time period associated with the fourth bonus game) has expired. In this embodiment, once the timer associated with one of the bonus game identifiers expires (i.e., once the predetermined time period associated with that bonus game identifier expires), the gaming system determines which player placed the most player identifiers in association with that bonus game identifier and provides that player with the premium outcome associated with that bonus game identifier (in this embodiment, with four plays of the fourth bonus game). The gaming system provides each of the other players who placed a player identifier in association with that bonus game identifier with the common outcome associated with that bonus game identifier (in this embodiment, with a play of the fourth bonus game). In other words, the gaming system notifies those players that they will receive either the premium outcome or the common outcome, and then provides each of those players with their respective outcomes. Since in this example the gaming system received the most player identifiers in association with the fourth bonus game identifier from the first player, the gaming system provides the first player with the premium outcome. Accordingly, the gaming system provides the fourth player with the common outcome.

It should be appreciated that the premium outcome and the common outcome may be any suitable award, event, bonus game, primary game feature, bonus game feature, or other outcome. For example, in one embodiment, the premium outcome is fifteen spins of a bonus game subject to a 3× multiplier, while the common outcome is eight spins of the bonus game subject to a 3× multiplier. In another embodiment, the premium outcome is a play of a bonus game with an advantage while the common outcome is a play of the bonus game without the advantage. For example, if the bonus game is a five card poker game in which a player attempts to make the best five card poker hand, the player receiving the premium outcome receives six cards rather than five cards during that poker game with which to make the player's best five card poker hand.

In certain of these embodiments, if the gaming system has received the same quantity of player identifiers in association with the same bonus game identifier from two or more players, upon expiration of the predetermined time period the gaming system provides both players with the premium outcome. In other embodiments, if the gaming system has received the same quantity of player identifiers in association with the same bonus game identifier from two or more players, upon expiration of the predetermined time period the gaming system provides neither player with the premium outcome; rather, the gaming system provides each player with the common outcome. In other embodiments, if the gaming system has received the same quantity of player identifiers in association with the same bonus game identifier from two or more players, upon expiration of the predetermined time period the gaming system provides each of the players with an equal fraction of the premium outcome. For example, if the premium outcome is ten free spins of a bonus game, the gaming system provides each player with five free spins of the bonus game, assuming two players placed the same quantity of player identifiers in association with the same bonus game player identifier. It should be appreciated that if a plurality of players have each placed the same quantity of player identifiers in association with the same bonus game identifier, upon expiration of the predetermined time period the gaming system may allocate any suitable portion of the premium outcome to each of those players. In another embodiment, if the gaming system has received the same quantity of player identifiers in association with the same bonus game identifier from two or more players, upon expiration of the predetermined time period the gaming system provides the first player to have placed that quantity of player identifiers in association with that bonus game identifier with the premium outcome, and the other players with the common outcome. For example, if player A and player B each placed four player identifiers in association with the same bonus game identifier, and player A was the first to place those four player identifiers (i.e., player A placed player A's fourth player identifier before player B placed player B's fourth player identifier), the gaming system provides player A with the premium outcome and player B with the common outcome. In another embodiment, if the gaming system has received the same quantity of player identifiers in association with the same bonus game identifier from two or more players, upon expiration of the predetermined time period the gaining system provides the first player to have accumulated that quantity of player identifiers with the premium outcome, and the other players with the common outcome. For example, if player A and player B each placed four player identifiers in association with the same bonus game identifier, and player A was the first to accumulate those four player identifiers, the gaming system provides player A with the premium outcome and player B with the common outcome.

In some of these embodiments, one or more of the bonus game identifiers is associated with a plurality of ranked outcomes. In these embodiments, the gaming system provides the ranked outcomes to players who placed one or more player identifiers in association with the bonus game identifier based on the quantity of player identifiers placed by the players. For example, the gaming system provides the player who placed the most player identifiers in association with the bonus game identifier with the highest ranked outcome, the gaming system provides the player who placed the second most player identifiers on the bonus game identifier with the next highest ranked outcome, and so on.

In various embodiments, the community selection game includes one or more upgrades that may be provided to a player or players. In these embodiments, the gaming system displays one or more upgrade identifiers in the community selection game area. Each of the displayed upgrade identifiers identifies an upgrade. In these embodiments, the gaming system enables players to place earned or received player identifiers in association with one or more of the upgrade identifiers rather than placing the player identifier in association with one of the bonus game identifiers. When the gaming receives a player identifier from a player in one or more of the upgrade identifiers, the gaming system provides the player with the upgrade identified by that upgrade identifier. In general, each of the upgrades is an advantage that the player may utilize in the community selection game.

In certain embodiments, the gaming system always enables players to place player identifiers in association with one of the upgrade identifiers. That is, in these embodiments, the gaming system enables a player to place a player identifier in association with an upgrade identifier regardless of whether the gaming system has previously received a player identifier in association with that upgrade identifier. In other embodiments, when the gaming system receives a player identifier in association with one of the upgrade identifiers, the gaming system displays that player identifier in association with that upgrade identifier until a triggering event, such as the expiration of a predetermined time period, occurs. When the triggering event occurs, the gaming system removes that player identifier from that upgrade identifier. Until then, however, the gaming system does not enable that upgrade identifier to receive any other player identifiers in association with that upgrade identifier.

In certain embodiments, the gaming system enables a player to place up to a maximum quantity of player identifiers in association with one (or, in some embodiments, one or more) of the upgrade identifiers. For example, in one embodiment, if a player earns multiple player identifiers, the gaming system enables the player to place up to a predetermined quantity of those player identifiers in association with a given one (or ones) of the upgrade identifiers. It should be appreciated that different upgrade identifiers may be associated with different maximum quantities of player identifiers. In some embodiments, the maximum quantity is associated with each individual player. That is, in these embodiments, each player may place up to the maximum quantity of player identifiers in association with the corresponding upgrade game identifier. In other embodiments, the maximum quantity is associated with all of the players, collectively. That is, in these embodiments, the players, as a whole, may place up to the maximum quantity of player identifiers in association with the corresponding upgrade game identifier. In some embodiments, once a given upgrade identifier has received the maximum quantity of player identifiers, the gaming system removes that upgrade identifier from play and may replace it with another upgrade identifier identifying a different upgrade. In some other embodiments, once a given upgrade identifier has received the maximum quantity of player identifiers, the gaming system removes the player identifiers (i.e., "resets" the upgrade identifier).

It should be appreciated that the upgrade may provide any suitable advantage to a player, such as an additional feature or event in the community selection game or the primary game. In one example, when the gaming system receives a player identifier in association with an upgrade identifier from a player, the gaming system provides the player with a plurality of (such as two) player identifiers rather than one player identifier the next time the triggering event occurs. In another example, when the gaming system receives a player identifier in association with an upgrade identifier from a player, the gaming system provides the player with a player identifier displayable at a single bonus game player identifier display area but representing a plurality of (such as two) player identifiers. In another example, when the gaming system receives a player identifier in association with an upgrade identifier from a player, the gaming system enables the player to remove one or more player identifiers of one or more players from one or more bonus game player identifier display areas, one or more bonus game identifiers, and/or one or more upgrade identifiers. In one example, the gaming system returns the removed player identifier or identifiers to their respective player or players, who may place the player identifier or identifiers on bonus game player identifier display areas the next time the players earn a player identifier via the triggering event. In another example, the gaming system returns the removed player identifier or identifiers to their respective players or players, who may immediately place the player identifier or identifiers on bonus game player identifier display areas.

In another example, when the gaming system receives a player identifier in association with an upgrade identifier from a player, the gaming system advances the predetermined time period associated with one of the bonus game identifiers. For example, if two minutes of a five minute predetermined time period have elapsed, when the player identifier is placed on the upgrade identifier the gaming system causes an additional minute to elapse such that three minutes of the five minute predetermined time period have elapsed rather than two minutes. In another example, when the gaming system receives a player identifier in association with an upgrade identifier from a player, the gaming system rewinds the predetermined time period associated with one of the bonus game identifiers. For example, if two minutes of a five minute predetermined time period have elapsed, when the player identifier is placed on the upgrade identifier the gaming system rewinds the predetermined time period one minute such that one minute of the five minute predetermined time period has elapsed rather than two minutes. It should be appreciated that which of the predetermined time periods is modified may be predetermined, randomly determined by the gaming system, determined based on a quantity of player identifiers placed in association with the upgrade identifier, selected by the player, or in any other suitable manner.

In another example, when the gaming system receives a player identifier in association with an upgrade identifier from a player, the gaming system provides the player with a key. The gaming system enables the player to use the key in association with one or more future player identifiers the gaming system provides to the player to enable the player to place that player identifier on a locked bonus game player identifier display area. Thus, in this example, for at least one bonus game player identifier display area, a player must acquire a key before the gaming system enables the player to place a player identifier in that bonus game player identifier display area. In certain embodiments, locked bonus game player identifier display areas are associated with bonus games that are more advantageous to players than bonus games associated with bonus game player identification display areas that are not locked. In certain of the embodiments described above that include bonus game identifiers associated with a predetermined time period, certain of the bonus game identifiers are locked for all of or a portion of the predetermined time period. In these embodiments, players must first acquire a key before the gaming system enables the player to place player identifiers in association with the locked bonus game identifiers. In various embodiments, once a player acquires a key that key may be used to unlock locked bonus game identifiers or bonus game player identifier display areas: (a) for a predetermined period of time; (b) a predetermined quantity of times, such as once; or (c) until the player's gaming session ends. In certain embodiments, the gaming system includes a plurality of different keys and a plurality of different corresponding locks that may be associated with bonus game identifiers, bonus game player identifier display areas, or upgrade identifiers.

In certain embodiments, an amount of a wager placed by a player for a play of one of the primary games does not affect the odds of that player receiving a player identifier. Put differently, the odds that the gaming system will provide a player with a player identifier are independent of the amounts of any wagers placed by that player. It should be appreciated, however, that in other embodiments the odds that the gaming system will provide a player with a player identifier are dependent upon the amounts of one or more of the player's wagers. In certain of these embodiments, for example, the player is more likely to receive a player identifier if the player places wagers having relatively high amounts than if the player places wagers having relatively low amounts.

In various embodiments, each player identifier provided to each player is associated with wager information regarding the amount wagered on the primary game during which that player identifier was provided to that player. In some of these embodiments, the gaming system uses that wager information to determine an award or awards to provide to that player when the gaming system provides that player with one or plays of a bonus game based on that player identifier being placed in association with one of the bonus game identifiers. In these embodiments, a bonus game provided to a player based on a player identifier associated with a relatively high wager amount is more likely to generate a relatively high award than a bonus game provided to a player based on a player identifier associated with a relatively low wager amount. To allow for the player's wager amount (e.g., quantity of credits wagered) to affect the outcome of the bonus game, the gaming system may award the player one player identifier for each one cent, five cents, ten cents, or twenty-five cents (or any other suitable amount) in the player's wager.

Thus, in these embodiments, the player is incentivized to place relatively higher wager amounts, as those higher wager denominations will cause the gaming system to provide the player with relatively larger quantities of player identifiers.

In another embodiment, when players earn a bonus game, the gaming system provides each player with a separate, independent play of the bonus game at the wager amount associated with the player identifier that triggered play of the bonus game. In one embodiment, if a player earned a bonus game through a combination of player identifiers associated with different wager amounts, then the gaming system provides the player with multiple separate, independent plays of the bonus game, one at each of the wager amounts associated with those player identifiers. For example, if a player placed two player identifiers in association with a bonus game identifier and earned one of the player identifiers through a $0.50 wager and another through a $1 wager, the gaming system provides the player one play of the bonus game at a $0.50 wager and another play of the bonus game at a $1 wager. In another embodiment, all players who earn a given bonus game are provided with the same shared bonus game. The gaming system awards each of the players based on the player identifiers of those players that triggered the bonus game.

In some of these embodiments, the gaming system uses the wager information such that the player's award in one or more plays of the bonus game or games is in line with the average expected payback of the primary game played by the player. Thus, it should be appreciated that a variety of players playing a variety of gaming devices having a variety of different average expected paybacks may all play the community selection game with one another without affecting any of the players' average expected paybacks in any bonus games. For example, games with a relatively lower average expected payback percentage allocated to the bonus game may award player identifiers less frequently than games with a relatively higher average expected payback percentage allocated to the bonus game.

It should be appreciated that each player identifier may take any suitable form. In one example, each player identifier is a symbol including an identifying characteristic of the player associated with that player identifier, such as the player's name, the player's player tracking number, an identification number of the gaming device being played by the player, or a unique player chosen identification number. In another example, each player identifier is a unique avatar or character provided to the player by the gaming system. In this example, the gaming system provides each player of one of the gaming devices of the gaming system with one of a plurality of avatars or characters not already provided to another one of the players of the gaming system (i.e., with a unique avatar or character). The avatars or characters may be any suitable avatars or characters, such as pirates, ninjas, cowboys, robots, knights, or sports players. In another example, each player identifier is a unique avatar or character created by the player or selected by the player.

In certain embodiments, the community selection game includes a set of a plurality of bonus games. In some of these embodiments, a subset of the bonus games included in that set—not all of the bonus games included in that set—is available and active at any given time in the community selection game. In other words, bonus game identifiers representing fewer than all of the set of bonus games are displayed in the community selection game at any given time. For example, if the community selection game includes a set of thirty bonus games, the gaming system displays five bonus game identifiers each identifying a different one of a subset of five of the thirty bonus games of the set of bonus games. In other words, in this example the gaming system does not display thirty bonus game identifiers each identifying a different one of the thirty bonus games of the set of bonus games. It should further be appreciated that the present disclosure contemplates changing the bonus games of the community selection game at various points in time, such as when each of the bonus game player identifier display areas associated with a bonus game identifier identifying one of the bonus games displays a player identifier, or when the timer associated with a bonus game identifier identifying one of the bonus games expires.

It should be appreciated that the primary wagering games may be any suitable wagering games such as, but not limited to, spinning reel-type games (e.g., slot games), card games such as poker or blackjack, roulette games, bingo games, or keno games. It should also be appreciated that the gaming system may include any suitable quantity of gaming devices. It should also be appreciated that the bonus games may include any suitable games such as, but not limited to, spinning reel-type games, card games such as poker or blackjack, roulette games, keno games, bingo games, wheel games, offer and acceptance games, and/or selection games.

In various embodiments, the gaming system enables a player to make an input, such as (but not limited to) clicking a mouse, touching a certain area on a touch screen, or actuating a designated button, to indicate that the player wishes to be provided with information regarding one or more of the bonus games identified by one or more of the bonus game identifiers and/or one or more of the upgrades identified by one or more of the upgrade identifiers. Upon receiving such an input, the gaming system provides the player with information regarding one or more of the bonus games or upgrades. The information may include, for example, instructions for playing the bonus game, rules of the bonus game, potential payouts for the bonus game, the premium outcome and the common outcome associated with the bonus game, and/or how the upgrade affects the community game. It should be appreciated that any suitable information may be provided.

In certain embodiments, each of the gaming devices is configured to display the community selection game on its respective display device. It should be appreciated that in other embodiments the community selection game is displayed on a communal display device viewable by each of the players instead of, or in addition to, being displayed on the display device of each individual gaming device.

In certain embodiments, when the gaming system receives a player identifier on one of the bonus game player identifier display areas from a player, the gaming system causes an animation, sound, or other effect unique to that player identifier to occur.

In some embodiments, the quantity of bonus game identifiers and/or the quantity of bonus game player identifier display areas depend upon the quantity of players playing the gaming system (i.e., how many of the gaming devices of the gaming system are being played). For example, in one embodiment, when a relatively large quantity of the gaming devices of the gaming system are being played, the gaming system displays a relatively large quantity of bonus game identifiers, and each of those bonus game identifiers includes a relatively large quantity of bonus game player identifier display areas. On the other hand, when a relatively small quantity of gaming devices of the gaming system are being played, the gaming system displays a relatively small quantity of bonus game identifiers, and each of those bonus game identifiers includes a relatively small quantity of bonus game player identifier display areas. It should be appreciated that, in certain embodiments, the quantity of bonus game identifiers and/or the quantity of bonus game player identifier display areas do not depend on the quantity of players playing the gaming system (i.e., the quantity of gaining devices of the gaming system being played).

In some embodiments, when the gaming system provides one or more plays of the bonus game to each of the players, those players play the bonus game independently from one another. Put differently, the gaming system does not enable the players to directly interact with one another while playing the bonus game. In certain other embodiments, however, the gaming system enables the players to interact with one another during play of certain of the bonus games. In these embodiments, the outcome of the bonus game for one or more of the players may depend on certain actions taken by one or more of the other players participating in the bonus game. For example, in one embodiment the players play a hand of poker against one another during play of the bonus game. In another example embodiment, the players participate in a group bonus game, such as a group selection game.

In certain embodiments, once each of the bonus game player identifier display areas of one of the bonus game identifiers displays a player identifier and the players associated with those player identifiers are provided with one or more plays of the bonus game identified by that bonus game identifier, the gaming system removes the displayed player identifiers from those bonus game player identifier display areas so that the players can begin displaying player identifiers in the player identifier display areas associated with that bonus game identifier. That is, in these embodiments the same bonus game is offered anew to players. In other embodiments, once each of the bonus game player identifier display areas of one of the bonus game identifiers displays a player identifier and the players associated with those player identifiers are provided with one or more plays of the bonus game identified by that bonus game identifier, the gaming system removes that bonus game identifier (including the bonus game player identifier display areas associated with that bonus game identifier) from the community selection game and replaces that bonus game identifier with a different bonus game identifier identifying a different bonus game. That is, in these embodiments, the gaming system replaces that bonus game with a new bonus game. It should be appreciated that, in these embodiments, players have more of an incentive to compete to place player identifiers in association with certain bonus games because those bonus games may be replaced with different bonus games.

In certain embodiments, once the predetermined time period of one of the bonus game identifiers expires, the gaming system removes any player identifier counters from that bonus game identifier. That is, in these embodiments, the gaming system resets that bonus game identifier such that the same bonus game is offered anew to players. In other embodiments, once the predetermined time period of one of the bonus game identifiers expires, the gaming system removes that bonus game identifier from the community selection game and replaces that bonus game identifier with a different bonus game identifier identifying a different bonus game. In these embodiments, the gaming system replaces that bonus game with a new bonus game. It should be appreciated that, in these embodiments, players have more of an incentive to compete to place player identifiers in association with certain bonus game because those bonus games may be replaced with different bonus games.

The present disclosure contemplates that the gaming system is configured to operate when a relatively low number of players are playing the gaming system. For example, in embodiments including a limited quantity of bonus game player identifier display areas, when a single player is playing the gaming system the gaming system may randomly select one or more of the bonus game player identifier display areas at which to display "dummy" player identifiers that are not associated with players playing the gaming machines. It should be appreciated that this enables the gaming system to provide the single player with plays of the bonus games more quickly than if the single player had to fill each of the bonus game player identifier display areas of a given bonus game identifier with the single player's player identifier. In another example, in embodiments including an unlimited quantity of bonus game player identifier display areas, the gaming system may randomly place one or more "dummy" player identifiers in association with one or more bonus game identifiers. It should be appreciated that, if the gaming system did not do so, the single player could win the premium outcome for each of the bonus games by placing one player identifier in association with the bonus game identifiers identifying those bonus games because no other players exist to place more player identifiers in association with those bonus game identifiers.

In various embodiments, the gaming system persistently stores a player's placed player identifiers in association with the player. In certain embodiments in which the games of the gaming system are played online (i.e., over a network), a player's placed player identifiers are stored in association with the player's casino account (or any other suitable tracking account). In these embodiments, if a player stops playing the games after the player has placed one or more player identifiers but before the gaming system provides the player with any bonus games associated with the placed player identifiers, the next time the player logs into the gaming system the gaming system notifies the player of any earned bonus games associated with those placed player identifiers and provides the player with plays of those bonus games. In certain embodiments in which the games are played at physical gaming machines, such as in a casino, a player's placed player identifiers are stored in association with a player tracking account or an sbX account associated with the player. In these embodiments, if a player stops playing the games after the player has placed one or more player identifiers but before the gaming system provides the player with any bonus games associated with the placed player identifiers, the next time the player inserts a player tracking card or otherwise identifies himself to the gaming system, the gaming system notifies the player of any earned bonus games associated with those placed player identifiers and provides the player with plays of those bonus games. In certain other embodiments, if a player stops playing after placing any player identifiers but before the gaming system provides the player with any bonus games associated with the placed player identifiers, the gaming system provides the player a predetermined award associated with each placed player identifier rather than any bonus games.

It should be appreciated that the bonus game identifiers may be any suitable bonus game, bonus feature, or bonus award identifier. For example, in certain embodiments the gaming system includes a bonus award identifier that identifies specific award amount, such as 1,000 credits. When each of the bonus award player identifier display areas display a player identifier, the players associated with those displayed player identifiers share that 1,000 credit award or, in some embodiments, the gaming system provides each of those players with the 1,000 credit award. In another example, the gaming system includes a bonus feature identifier that identifies a bonus feature, such as a "double player identifier" feature. In this example, when each of the bonus feature player identifier display areas display a player identifier, the players associated with those displayed player identifiers are each provided with a "double player identifier" feature for a predetermined period of time or a predetermined quantity of plays of the primary game. That is, any player identifiers earned by the players will be doubled.

In some embodiments, the gaming system enables the players to accumulate player identifiers rather than placing them on one or more bonus game player identifier display areas or in association with one of the bonus game identifiers or the upgrade identifiers. This enables players to save player identifiers if the players do not want to play any of the available bonus games. At a subsequent point in time, after one or more of the available bonus games have been replaced, the player may then place one or more of the player's accumulated player identifiers.

In certain embodiments, rather than or in addition to enabling a player to place player identifiers in association with bonus game identifiers or in empty bonus game player identifier display areas, the gaming system automatically places the player identifiers in accordance with one or more criteria. In some embodiments, the gaming system places the player identifiers based on the quantity of bonus game player identifier display areas available. In other embodiments, the gaming system places the player identifiers based on the quantity of player identifiers already placed in association with the bonus game identifiers. In other embodiments, the gaming system places the player identifiers based on a player's history of player identifier placement (which may be stored in a player tracking account). In various embodiments, the gaming system places the player identifiers to maximize the player's probability of winning the premium outcome associated with one or more bonus game identifiers. In other embodiments, the gaming system places the player identifiers to maximize the quantity of bonus games provided to the player. In some embodiments, the gaming system places the player identifiers in association with previously-placed player identifiers of a predetermined group of players. In other embodiments, the gaming system randomly places the player identifiers. In certain embodiments, the gaming system enables the player to customize the criteria by which the gaming system places player identifiers. For example, one player may choose to have the gaming system place player identifiers to maximize that player's chance of winning the premium outcome, while another player may choose to have the gaming system place player identifiers to maximize that player's quantity of bonus games. In other embodiments, the gaming system enables the player to choose to select where to place the player identifiers or to have the gaming system do so.

In some embodiments, the gaming system includes a plurality of teams, each of which is associated with a different team identifier such as an avatar. In these embodiments, upon initiation of a gaming session, the gaming system enables a player to select one of the teams. When the triggering event occurs, the gaming system provides the player with one or more of the team identifiers of the selected team rather than one or more player identifiers. It should thus be appreciated that, in these embodiments, players that are part of a team work together to place player identifiers on bonus game team identifier display areas or in association with bonus game identifiers in order to win bonus awards, features, or games.

In certain of these embodiments, the gaming system enables players to place earned team identifiers on one or more bonus game team identifier display areas in the manner generally described above with respect to FIGS. 4A, 4B, 4C, 4D, and 4E. Once each of the bonus game team identifier display areas of one of the bonus game identifiers display a team identifier, the gaming system provides each team associated with those team identifiers with a play of the bonus game identified by the bonus game identifier. In some embodiments, each team member receives an equal share of any award provided for the play of the bonus game. In other embodiments, team members receive prorated shares of any award provided for the play of the bonus game. In one embodiment, team members receive a share of any award based on the quantity of bonus game team identifier display areas at which the team members placed a team identifier. For example, if Team A includes Players A, B, and C, Player A placed two team identifiers on bonus game 1 team identifier display areas, and Players B and C each placed one team identifier on bonus game 1 team identifier display areas, Player A receives one-half and Players B and C each receive one-fourth of any award provided for the play of bonus game 1.

In other embodiments, the gaming system enables the player to place the team identifier or identifiers in association with one or more bonus game identifiers in the manner generally described above with respect to FIGS. 5A, 5B, 5C, and 5D. Once the predetermined time period associated with one of the bonus game identifiers expires, the gaming system provides the team that placed the most team identifiers in association with that bonus game identifier with a premium outcome, and provides each of the other teams that placed at least one team identifier in association with that bonus game identifier with a common outcome. It should be appreciated that any awards may be shared in manners similar to those described above.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

(a) a plurality of gaming devices, each of the gaming devices including:
  (i) a housing;
  (ii) at least one processor;
  (iii) a plurality of input devices supported by the housing, the plurality of input devices including
    (1) an acceptor of a first physical item associated with a first monetary value,
    (2) a validator configured to identify the first physical item, and
    (3) a cashout device configured to receive an input to cause an initiation of a payout associated with a credit balance;
  (iv) at least one display device supported by the housing; and
  (v) at least one memory device storing a plurality of instructions which, when executed by the at least one processor, cause the at least one processor to operate with the at least one display device and the plurality of input devices; and (b) a controller configured to operate with the gaming devices to:
  (i) cause a display of a plurality of bonus game identifiers, each of the bonus game identifiers identifying a bonus game;

(ii) for each of the gaming devices, upon an occurrence of a triggering event, provide a player of said gaming device with one or more player identifiers associated with the player and enable the player to associate one or more of the player identifiers with one or more of the bonus game identifiers; and (iii) for each of the bonus game identifiers, when a designated quantity of player identifiers has been associated with said bonus game identifier, the designated quantity of player identifiers being distinct from a quantity of players of the plurality of gaming devices, for each player associated with one of the player identifiers associated with said bonus game identifier, provide said player with one or more plays of the bonus game identified by said bonus game identifier.

2. The gaming system of claim 1, wherein each of the plurality of bonus game identifiers identifies a different bonus game.

3. The gaming system of claim 1, wherein the controller is configured to operate with the gaming devices to, for each of the bonus game identifiers, when the designated quantity of player identifiers has been associated with said bonus game identifier, if a plurality of the player identifiers associated with said bonus game identifier are associated with a same player, provide said player with a modifier in the bonus game.

4. The gaming system of claim 3, wherein the modifier is a multiplier having a value based on a quantity of player identifiers associated with said bonus game identifier that are associated with said player.

5. The gaming system of claim 1, wherein the controller is configured to operate with the gaming devices to:

(i) cause a display of a plurality of upgrade identifiers, each of the upgrade identifiers identifying an upgrade and being separate from the bonus identifiers;

(ii) for each of the gaming devices, enable the player of said gaming device to associate one or more player identifiers provided to the player with one or more of the upgrade identifiers; and (iii) for each of the upgrade identifiers, when the player associates a player identifier with said upgrade identifier, provide the upgrade associated with said upgrade identifier to the player.

6. The gaming system of claim 5, wherein the upgrade provides an advantage to the player.

7. The gaming system of claim 1, wherein the designated quantity of player identifiers is different for at least two of the bonus identifiers.

8. The gaming system of claim 1, wherein, for each player, the player identifier provided to said player uniquely identifies said player.

9. The gaming system of claim 1, wherein the game is a spinning reel game including a plurality of reels having a plurality of symbols, and the triggering event occurs when a designated symbol combination is generated and displayed on the reels.

10. The gaming system of claim 1, wherein the controller is configured to operate with the gaming devices to cause a display of each player identifier associated with each of the bonus game identifiers.

11. The gaming system of claim 1, wherein the controller is configured to operate with the gaming devices to, for each of the gaming devices, enable one or more wagers to be placed for one or more plays of one or more games.

12. A method of operating a gaming system, said method comprising:

(a) causing at least one processor to execute a plurality of instructions stored in at least one memory device to cause a display of a plurality of bonus game identifiers, each of the bonus game identifiers identifying a bonus game;

(b) upon an occurrence of a triggering event, providing a player of one of a plurality of gaming devices with one or more player identifiers associated with the player and enabling the player to associate one or more of the player identifiers with one or more of the bonus game identifiers; and (c) for each of the bonus game identifiers, when a designated quantity of player identifiers has been associated with said bonus game identifier, the designated quantity of player identifiers being distinct from a quantity of players of the plurality of gaming devices, for each player associated with one of the player identifiers associated with said bonus game identifier, providing said player with one or more plays of the bonus game identified by said bonus game identifier and increasing a credit balance of said player based on any awards associated with said one or more plays of the bonus game, said credit balance being:

(i) increasable via receipt, by an acceptor, of a first physical item associated with a first monetary value and identification, by a validator, of the received first physical item; and (ii) decreasable via actuation of a cashout device to cause an initiation of a payout associated with said credit balance.

13. The method of claim 12, wherein each of the plurality of bonus game identifiers identifies a different bonus game.

14. The method of claim 12, which includes, when the designated quantity of player identifiers has been associated with said bonus game identifier, if a plurality of the player identifiers associated with said bonus game identifier are associated with a same player, providing said player with a modifier in the bonus game.

15. The method of claim 13, wherein the modifier is a multiplier having a value based on a quantity of player identifiers associated with said bonus game identifier that are associated with said player.

16. The method of claim 12, which includes:

(i) causing the at least one processor to execute the plurality of instructions to cause a display of a plurality of upgrade identifiers, each of the upgrade identifiers identifying an upgrade and being separate from the bonus identifiers;

(ii) for each of the gaming devices, enabling the player of said gaming device to associate one or more player identifiers provided to the player with one or more of the upgrade identifiers; and (iii) for each of the upgrade identifiers, when the player associates a player identifier with said upgrade identifier, providing the upgrade associated with said upgrade identifier to the player.

17. The method of claim 16, wherein the upgrade provides an advantage to the player.

18. The method of claim 12, wherein the designated quantity of player identifiers is different for at least two of the bonus identifiers.

19. The method of claim 12, wherein, for each player, the player identifier provided to said player uniquely identifies said player.

20. The method of claim 12, wherein the game is a spinning reel game including a plurality of reels having a plurality of symbols, and the triggering event occurs when a designated symbol combination is generated and displayed on the reels.

21. The method of claim 12, which includes causing the at least one processor to execute the plurality of instructions to cause a display of each player identifier associated with each of the bonus game identifiers.

22. The method of claim 1, which includes enabling one or more wagers to be placed for one or more plays of one or more games.

23. The method of claim 12, which is provided through a data network.

24. The method of claim 23, wherein the data network is an internet.

25. A non-transitory computer readable medium including a plurality of instructions which, when executed by at least one processor, cause the at least one processor to:

(a) cause at least one display device to display a plurality of bonus game identifiers, each of the bonus game identifiers identifying a bonus game;

(b) upon an occurrence of a triggering event, provide a player of one of a plurality of gaming devices with one or more player identifiers associated with the player and enable the player to associate one or more of the player identifiers with one or more of the bonus game identifiers; and (c) for each of the bonus game identifiers, when a designated quantity of player identifiers has been associated with said bonus game identifier, the designated quantity of player identifiers being distinct from a quantity of players of the plurality of gaming devices, for each player associated with one of the player identifiers associated with said bonus game identifier, provide said player with one or more plays of the bonus game identified by said bonus game identifier and increase a credit balance of said player based on any awards associated with said one or more plays of the bonus game, said credit balance being:

(i) increasable via receipt, by an acceptor, of a first physical item associated with a first monetary value and identification, by a validator, of the received first physical item; and (ii) decreasable via actuation of a cashout device to cause an initiation of a payout associated with said credit balance.

26. The non-transitory computer readable medium of claim 25, wherein each of the plurality of bonus game identifiers identifies a different bonus game.

27. The non-transitory computer readable medium of claim 25, wherein the plurality of instructions, when executed by the at least one processor, cause the at least one processor to, for each of the bonus game identifiers, when the designated quantity of player identifiers has been associated with said bonus game identifier, if a plurality of the player identifiers associated with said bonus game identifier are associated with a same player, provide said player with a modifier in the bonus game.

28. The non-transitory computer readable medium of claim 27, wherein the modifier is a multiplier having a value based on a quantity of player identifiers associated with said bonus game identifier that are associated with said player.

29. The non-transitory computer readable medium of claim 25, wherein the plurality of instructions, when executed by the at least one processor, cause the at least one processor to:

(i) cause a display of a plurality of upgrade identifiers, each of the upgrade identifiers identifying an upgrade and being separate from the bonus identifiers;

(ii) for each of the gaming devices, enable the player of said gaming device to associate one or more player identifiers provided to the player with one or more of the upgrade identifiers; and (iii) for each of the upgrade identifiers, when the player associates a player identifier with said upgrade identifier, provide the upgrade associated with said upgrade identifier to the player.

30. The non-transitory computer readable medium of claim 29, wherein the upgrade provides an advantage to the player.

31. The non-transitory computer readable medium of claim 25, wherein the designated quantity of player identifiers is different for at least two of the bonus identifiers.

32. The non-transitory computer readable medium of claim 25, wherein, for each player, the player identifier provided to said player uniquely identifies said player.

33. The non-transitory computer readable medium of claim 25, wherein the game is a spinning reel game including a plurality of reels having a plurality of symbols, and the triggering event occurs when a designated symbol combination is generated and displayed on the reels.

34. The non-transitory computer readable medium of claim 25, wherein the plurality of instructions, when executed by the at least one processor, cause the at least one processor to cause the at least one display device to display each player identifier associated with each of the bonus game identifiers.

35. The non-transitory computer readable medium of claim 25, wherein the plurality of instructions, when executed by the at least one processor, cause the at least one processor to enable one or more wagers to be placed for one or more plays of one or more games.

* * * * *